US008995673B2

(12) United States Patent
Mihelich et al.

(10) Patent No.: US 8,995,673 B2
(45) **Date of Patent: *Mar. 31, 2015**

(54) AUDIO POWER MANAGEMENT SYSTEM

(75) Inventors: Ryan J. Mihelich, Farmington Hills, MI (US); Jeffrey Tackett, Allen Park, MI (US); Douglas K. Hogue, Farmington Hills, MI (US)

(73) Assignee: Harman International Industries, Incorporated, Northridge, CA (US)

( * ) Notice: Subject to any disclaimer, the term of this patent is extended or adjusted under 35 U.S.C. 154(b) by 332 days.

This patent is subject to a terminal disclaimer.

(21) Appl. No.: 13/488,110

(22) Filed: Jun. 4, 2012

(65) Prior Publication Data

US 2012/0237045 A1 Sep. 20, 2012

Related U.S. Application Data

(63) Continuation of application No. 12/725,941, filed on Mar. 17, 2010, now Pat. No. 8,194,869.

(51) Int. Cl.
*H04R 29/00* (2006.01)
*H04R 3/00* (2006.01)

(52) U.S. Cl.
CPC ..... *H04R 3/002* (2013.01); *H04R 3/007* (2013.01); *H04R 29/001* (2013.01)
USPC ..... 381/59; 381/55; 381/58; 381/96; 381/98

(58) Field of Classification Search
CPC ..... H04R 3/002; H04R 29/001; H04R 3/007; H04R 3/04; H04R 3/00; H04R 5/04; H04R 29/00
USPC ..... 381/59, 58, 55, 96, 98
See application file for complete search history.

(56) References Cited

U.S. PATENT DOCUMENTS 4,969,195 A * 11/1990 Noro ..... 381/96
5,581,621 A 12/1996 Koyama et al. ..... 381/103

(Continued)

FOREIGN PATENT DOCUMENTS

CN 1215540 A 4/1999
EP 0340762 A2 11/1989 ..... H04R 3/04

(Continued)

OTHER PUBLICATIONS

Japanese Office Action dated Jun. 5, 2009, issued in Japanese Patent Application No. 2007-530515, with English translation, 13 pages.

(Continued)

*Primary Examiner* — Paul S Kim
(74) *Attorney, Agent, or Firm* — Brooks Kushman P.C.

(57) ABSTRACT

An audio power management system manages operation of audio devices in an audio system. The audio power management system includes a parameter computer, a threshold comparator and a limiter. Audio signals generated with the audio system may be provided to the audio power management system. Based on a measured actual parameter of the audio signal, such as a real-time actual voltage and/or a real-time actual current, the parameter computer can derive estimated operational characteristics of audio devices, such as a loudspeaker included in the audio system. The threshold comparator may use the estimated operational characteristics to develop a threshold and manage operation of one of more devices in the audio system by monitoring the measured actual parameter, and selectively directing the limiter to adjust the audio signal, or another device in the audio system to protect or optimize performance.

20 Claims, 14 Drawing Sheets

(56) References Cited

U.S. PATENT DOCUMENTS

| | | | | |
|---|---|---|---|---|
| 6,449,368 | B1 | 9/2002 | Davis et al. | 381/1 |
| 6,674,864 | B1 | 1/2004 | Kitamura | 381/103 |
| 7,391,869 | B2 | 6/2008 | Eid et al. | 381/22 |
| 7,526,093 | B2 | 4/2009 | Devantier | 381/59 |
| 8,194,869 | B2 | 6/2012 | Mihelich et al. | |
| 2001/0017921 | A1 | 8/2001 | Ohta | 381/98 |
| 2004/0125487 | A9 | 7/2004 | Sternad et al. | 360/65 |
| 2004/0125967 | A1 | 7/2004 | Eid et al. | 381/99 |
| 2004/0258259 | A1 | 12/2004 | Koyama | 381/307 |
| 2005/0031129 | A1 | 2/2005 | Devantier | 381/18 |
| 2005/0031130 | A1 | 2/2005 | Devantier | 381/59 |
| 2005/0031135 | A1 | 2/2005 | Devantier | 381/59 |
| 2005/0031143 | A1 | 2/2005 | Devantier et al. | 381/300 |
| 2005/0063554 | A1 | 3/2005 | Devantier | 381/99 |
| 2005/0069153 | A1 | 3/2005 | Hall et al. | 381/103 |
| 2006/0147057 | A1 | 7/2006 | Aggarwal et al. | 381/103 |
| 2007/0025559 | A1 | 2/2007 | Mihelich et al. | 381/59 |

FOREIGN PATENT DOCUMENTS

| | | | | |
|---|---|---|---|---|
| EP | 0898364 | A2 | 2/1999 | H03H 21/00 |
| EP | 1126744 | A2 | 8/2001 | H04S 3/00 |
| EP | 1355514 | A2 | 10/2003 | H04S 3/00 |
| EP | 1523221 | A2 | 4/2005 | H04S 7/00 |
| JP | 2001095080 | A | 4/2001 | |
| JP | 2001-224099 | A | 8/2001 | H04S 7/00 |
| JP | 2002-369299 | A | 12/2002 | H04S 5/02 |
| JP | 2003503989 | A | 1/2003 | |
| JP | 2004-007604 | | 1/2004 | H04R 27/00 |
| JP | 2005-012534 | A | 1/2005 | H04S 5/02 |
| JP | 2005-151539 | A | 6/2005 | H04R 3/12 |
| JP | 2009266600 | A | 11/2009 | |
| JP | 2010010954 | A | 1/2010 | |
| JP | 2011146482 | A | 7/2011 | |
| WO | WO 2007/116802 | A1 | 10/2007 | H04S 5/02 |

OTHER PUBLICATIONS

Office Action dated Mar. 8, 2010, issued in Japanese Patent Application No. 2007-530515 (8 pages with English translation).

Office Action dated Feb. 28, 2008, in Korean Patent Application No. 10-2007-7003971 (5 pages).

Notice of Decision for Patent dated Mar. 24, 2009, issued in Korean Patent Application No. 10-2007-7003971 (5 pages with English translation).

Office Action dated May 22, 2008, in Canadian Patent Application No. 2,568,916 (3 pages).

Office Action dated Dec. 18, 2008, in European Patent Application No. 06 789 045.9 (5 pages).

Office Action dated Mar. 20, 2009, issued in Chinese Patent Application No. 200680001063.2 (10 pages with English translation).

Office Action dated Sep. 25, 2009, issued in Chinese Patent Application No. 200680001063.2 (6 pages with English translation).

Office Action dated Sep. 25, 2009, issued in Chinese Patent Application No. 200680001063.2 (English translation, 4 pages), Correct date believed to be Jan. 8, 2010.

European Search Report dated, Aug. 29, 2011, pp. 1-6, European Patent Application No. 11157391.1, European Patent Office, Germany.

Birt, David, Loudspeaker Power Amplifiers with Load-Adaptive Source Impedance, 1988, pp. 552-561, vol. 36, No. 7/8, Journal of the Audio Engineering Society, New York.

European Search Report dated, Oct. 31, 2014, 7 pages, European Patent Application No. EP14175939, European Patent Office, Germany.

* cited by examiner

AUDIO POWER MANAGEMENT SYSTEM

PRIORITY CLAIM

This application is a continuation of U.S. application Ser. No. 12/725,941, filed Mar. 17, 2010, now U.S. Pat. No. 8,194,869, the disclosure of which is incorporated in its entirety by reference herein.

BACKGROUND OF THE INVENTION

1. Technical Field

This invention relates to audio systems, and more particularly to an audio power management system for use in an audio system.

2. Related Art

Audio systems typically include an audio source providing audio content in the form of an audio signal, an amplifier to amplify the audio signal, and one or more loudspeakers to convert the amplified audio signal to sound waves. Loudspeakers are typically indicated by a loudspeaker manufacturer as having a nominal impedance value, such as 4 ohms or 8 ohms. In reality, the impedance of a loudspeaker varies with frequency. Variations in loudspeaker impedance with respect to frequency may be shown with a loudspeaker impedance curve, which is typically provided by the manufacturer with a manufactured model of a loudspeaker.

A loudspeaker, however, is an electromechanical device that is sensitive to variations in voltage and current, as well as environmental conditions, such as temperature and humidity. In addition, during operation a loudspeaker voice coil may be subject to heating and cooling dependent on the level of amplification of the audio content. Moreover, variations in manufacturing and materials among a particular loudspeaker design may also cause significant deviation in a loudspeaker's pre-specified parameters.

Thus, loudspeaker parameters such as the DC resistance, moving mass, resonance frequency and inductance may vary significantly among the same manufactured model of a loudspeaker, and also may change significantly as operating and environmental conditions change. As such, an impedance curve is created with a large number of relatively uncontrollable variables represented as if all these uncontrollable variables were fixed and non-varying. Accordingly, a manufacturer's impedance curve for a particular model of a loudspeaker may be significantly different from the actual operational impedance of the loudspeaker. In addition, an acceptable range of variations in the audio signal driving the loudspeaker may also vary based on the loudspeaker parameters of a particular loudspeaker and the operational conditions.

SUMMARY

An audio power management system may be implemented in an audio system to manage operation of devices such as loudspeakers, amplifiers and audio sources. Management of the devices in the audio system may be based on real-time customization of operational parameters of one or more of the devices in accordance with real-time actual measured parameters, and real-time estimated parameters.

Management of the ongoing operation of one or more devices in the audio system may be performed to accomplish both protection of the hardware, and optimization of system performance. Based on real-time estimated and actual operational capabilities of the specific hardware in the system, protective and operational threshold parameters that are developed in real-time specifically for the system hardware may be subject to ongoing adjustment as the system operates. Due to continuing adjustment of the operational and protective parameters, devices may be operated at, above, or below manufacturer specified ratings while minimizing or eliminating possible compromise of the integrity of the hardware, or operational performance of the audio system due to the thresholds being developed in real-time.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
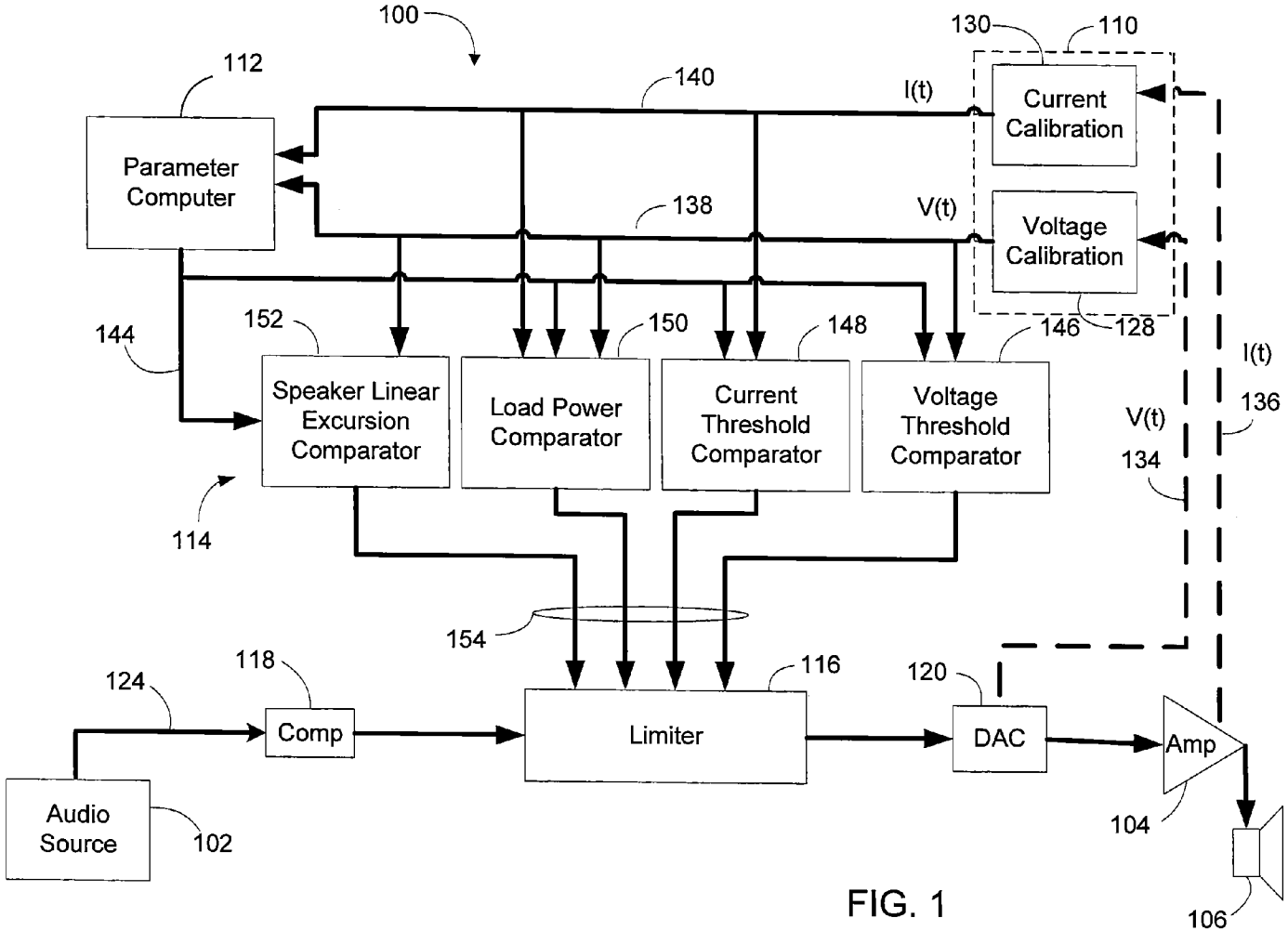
FIG. 1 is an example block diagram of a power management system included in an audio system.

FIG. 1 is an example block diagram of a audio power management system 100. The audio power management system 100 may be included in audio system having an audio source 102, an audio amplifier 104, and at least one loudspeaker 106. An audio system that includes the power management system 100 may be operated in any listening space such as a room, a vehicle, or in any other space where an audio system can be operated. The audio system may be any form of multimedia system capable of providing audio content.

The audio source 102 may be a source of live sound, such as a singer or a commentator, a media player, such as a compact disc, video disc player, a video system, a radio, a cassette tape player, an audio storage device, a wireless or wireline communication device, a navigation system, a personal computer, or any other functionality or device that may be present in any form of multimedia system. The amplifier 104 may be a voltage amplifier, a current amplifier or any other mechanism or device capable of receiving an audio input signal, increasing a magnitude of the audio input signal, and providing an amplified audio output signal to drive the loudspeaker 106. The amplifier 104 may also perform any other processing of the audio signal, such as equalization, phase delay and/or filtering. The loudspeaker 106 may be any number of electro-mechanical devices operable to convert audio signals to sound waves. The loudspeakers may be any size contain any number of different sound emitting surfaces or devices, and operate in any range or ranges of frequency. In other examples, the configuration of the audio system may include additional components, such as pre or post equalization capability, a head unit, a navigation unit, an onboard computer, a wireless communication unit, and/or any other audio system related functionality. In addition, in other examples the power management system may be dispersed and/or located in different parts of the audio system, such as following or within the amplifier, at or within the loudspeaker, or at or within the audio source.

The example power management system 100 includes a calibration module 110, a parameter computer 112, one or more threshold comparators 114, and a limiter 116. The power management system 100 may also include a compensation block 118 and a digital to analog converter (DAC) 120. The power management system 100 may be hardware in the form of electronic circuits and related components, software stored as instructions in a tangible computer readable medium that are executable by a processor, such as digital signal processor, or a combination of hardware and software. The tangible computer readable medium may be any form of data storage device or mechanism such as nonvolatile or volatile memory, ROM, RAM, a hard disk, an optical disk, a magnetic storage media and the like. The tangible computer readable media is not a communication signal capable of electronic transmission.

In one example, the power management system 100 may be implemented with a digital signal processor and associated memory, and a signal converter, such as a digital to analog signal converter. In other examples, greater or fewer numbers of blocks may be depicted to provide the functionality described.

During operation, a digital signal may be supplied to the power management system 100 on an audio signal line 124. The digital signal may be representative of a mono signal, a stereo signal, or a multi-channel signal such as a 5, 6, or 7 channel surround audio signal. Alternatively, the audio signal may be supplied as an analog signal to the power management system 100. The audio signal may vary in current and/or voltage as the audio content varies over a wide range of frequencies that includes 0 Hz to 20 kHz or some range within 0 Hz to 20 kHz.

The power management system 100 may operate in the time domain such that time based samples or snapshots of the audio signal are provided to the calibration module 110. The calibration module 110 may include a voltage calibration module 128 and a current calibration module 130. The voltage calibration module 128 may receive a voltage signal indicative of a real-time actual voltage V(t) of the audio signal representative of the real-time voltage received at the loudspeaker 106. The voltage signal may be proportional to the voltage of the audio signal. Due to variations in operational conditions and hardware, such as length and gauge of the wires carrying the audio signal, the real-time actual voltage V(t) is an estimate of the voltage at the loudspeaker 106. In that regard, although receipt of the real-time actual voltage V(t) of the audio signal by the power management system 100 is illustrated as occurring between the limiter 116 and the amplifier 104, the estimated voltage of the loudspeaker 106 may be measured at the loudspeaker 106, at the amplifier 104 or anywhere else where a repeatable representation of the real-time actual voltage V(t) of the audio signal that is capable of being calibrated to be representative of an estimate of the voltage at the loudspeaker 106 may be obtained.

In FIG. 1, the audio signal is received by the DAC 120, converted in real-time from a digital signal to an analog signal, and supplied on a real-time actual voltage line 134. The DAC 120 may be any algorithm and/or circuit capable of converting digital data to analog data. In other examples, the audio signal may be an analog signal, and the DAC 120 may be omitted. The audio signal may be sampled at a predetermined rate such as 44.1 KHz, 48 KHz or 96 KHz. As used herein, the term "real-time" refers to processing and other operations that occur substantially immediately upon receipt of one or more samples or snapshots of the audio signal by the power management system 100 such that the power management system 100 is reactive to processing the continuous flow of audio content being received in the audio signal and generating corresponding outputs responsive to the continuous flow.

The current calibration module 130 may similarly receive a current signal indicative of real time actual current I(t) of the audio signal received at the loudspeaker 106. A current sensor, such as a resistor across the input terminals of the loudspeaker 106, a Hall effect sensor installed in, on or in nearby vicinity to the loudspeaker 106, or any other form of sensor capable of providing a signal representative of current of an audio signal being supplied to the loudspeaker 106 may be used to obtain a variable voltage proportional to the real-time current that is representative of an estimate of the current received by the loudspeaker 106. The real-time actual current I(t) may be supplied to the calibration module 110 on a real-time current supply line 136.

The calibration module 110 may perform conditioning of the measured actual parameter(s). Conditioning may include band limiting the received measured actual parameter, adding latency and/or phase shift to the measure actual parameter, performing noise compensation, adjusting the frequency response, compensating for distortion, and/or scaling the measured actual parameter(s). The conditioned signal representative of current and the conditioned signal representative of voltage may be provided to the parameter computer 112 and one or more of the threshold comparators 114 as real-time signals on a conditioned real-time actual voltage line 138, and a real-time actual current line 140, respectively.

The parameter computer 112 may develop estimated operational characteristics for hardware contained in the audio system. Estimated operational characteristics may be developed by the parameter computer 112 using measured actual parameters, models, simulations, databases, or any other information or method to recreate operational functionality and parameters of devices in the audio system.

For example, the parameter computer 112 may develop an estimated speaker model in real-time for the loudspeaker 106 based on operating conditions of the audio system, such as the one or more conditioned measured actual parameters or one or more measured actual parameters. In one example, the parameter computer 112 may develop an impedance curve in real-time for the loudspeaker 106 at predetermined intervals, such as each time a predetermined number of samples of the one or more measured actual parameters are received. The developed impedance curve may be an estimate of the operational characteristics of the loudspeaker 106. In another example, the parameter computer 112 may generate estimated operational characteristics, such as DC resistance, moving mass, resonant frequency, inductance or any other speaker parameters associated with a loudspeaker. In still other examples, other forms of operational characteristics may be implemented with the parameter computer 112, such as fitting to enclosed loudspeaker models, crossover adaption models, or any other form of model representative of loudspeaker behavior.

Figure 2:
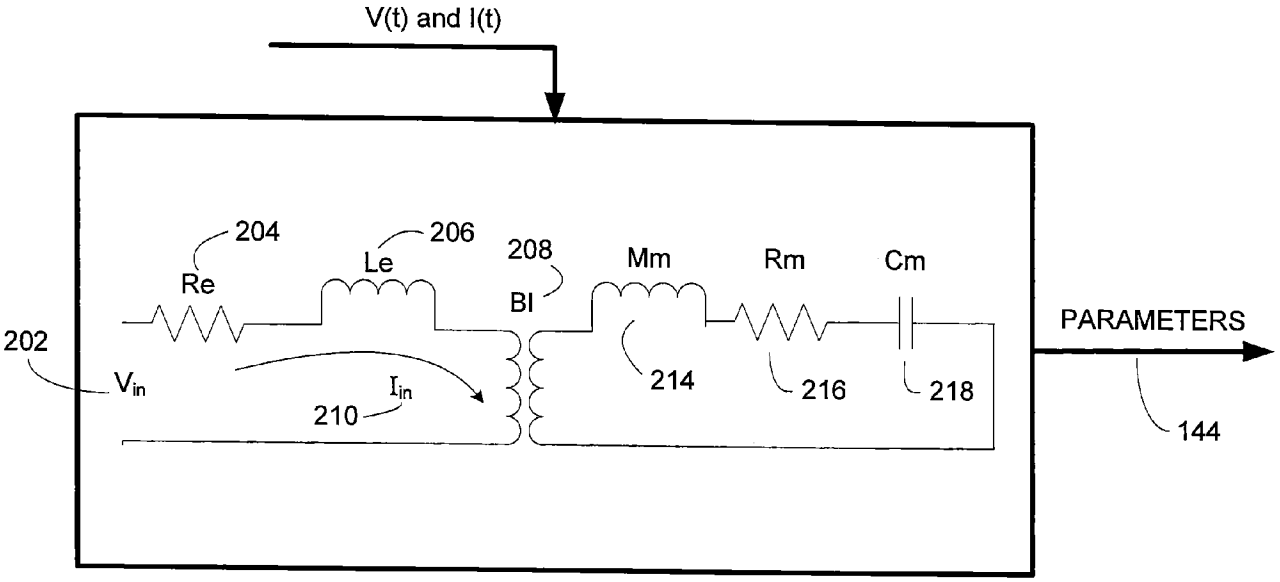
FIG. 2 is an example of loudspeaker modeling.
Figure 2:
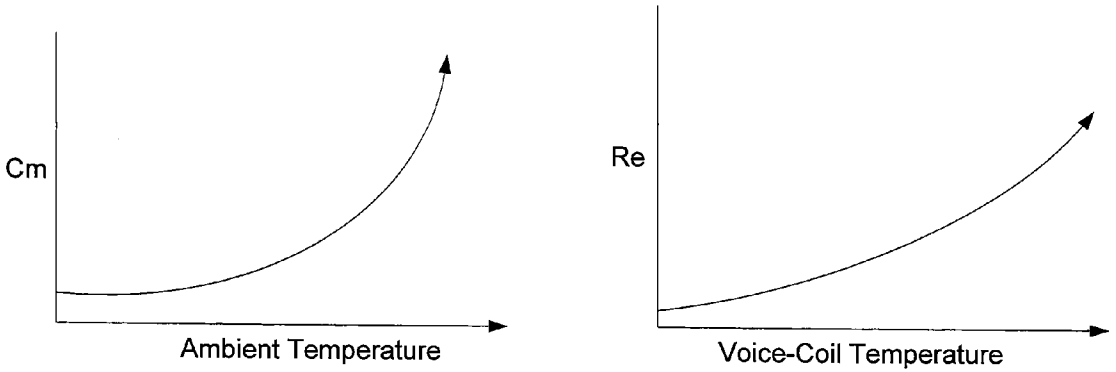

FIG. 2 is an example equivalent circuit model representative of speaker parameters of the loudspeaker 106. An input voltage (Vin) 202 may be supplied as the driving voltage of the loudspeaker 106, which is equivalent to the real-time actual voltage V(t). An electrical input impedance of the loudspeaker 106 may be represented with a voice coil resistance (Re) 204 and a voice coil inductance (Le) 206. The voice coil resistance Re 204 also may be representative of variations in the voice-coil temperature. FIG. 2 includes an example curve illustrating the correlation between voice coil temperature and the voice coil resistance Re 204. A motor flux density (Bl) 208 may be representative of the motional electromotive force of the loudspeaker 106. An input current Iin 210, which may be equivalent to the real-time actual current I(t) may flow as indicated through the transformer representing the motor of the loudspeaker 106.

A mechanical impedance of the loudspeaker 106 that includes the mass, resistance, and stiffness of a loudspeaker suspension system included in the loudspeaker 106 may be represented with a mechanical inductance Mm 214, a mechanical resistance Rm 216 and a mechanical compliance Cm 218. The mechanical compliance Cm 218 may be representative of the stiffness or compliance of the loudspeaker 106. Thus, the mechanical compliance Cm 218 also may be representative of changes in ambient temperature surrounding the loudspeaker 106, and/or the temperature of the loudspeaker suspension system. FIG. 2 includes an example curve illustrating the correlation between ambient temperature and the mechanical compliance Cm 218. In other examples, other models may be used to model the speaker parameters of a loudspeaker. In addition, other models may be used to model other devices within the audio system.

The parameter computer 112 may not only determine the estimated real-time parameters, such as speaker parameters, but also may vary the determined estimated real-time parameters over time as the device, such as the loudspeaker 106 operates and the one of more measured actual parameters vary. As previously discussed, the parameter computer 112 may receive the one or more measured actual parameters in the time domain, however, the solutions representative of the estimated speaker parameters may be generated in the frequency domain. For example, the parameter computer 112 may use a fast Fourier Transform (FFT) to obtain the estimated impedance of the loudspeaker 106 in the frequency domain and solve for various speaker parameters using blocks of the audio signal divided into a predetermined size. In another example, in the time domain the estimate impedance of the loudspeaker may be calculated every predetermined number of samples, such as up to a sample-by-sample basis. Accordingly, as the one or more measured actual parameters vary, the estimated speaker parameters correspondingly may vary.

Figure 3:
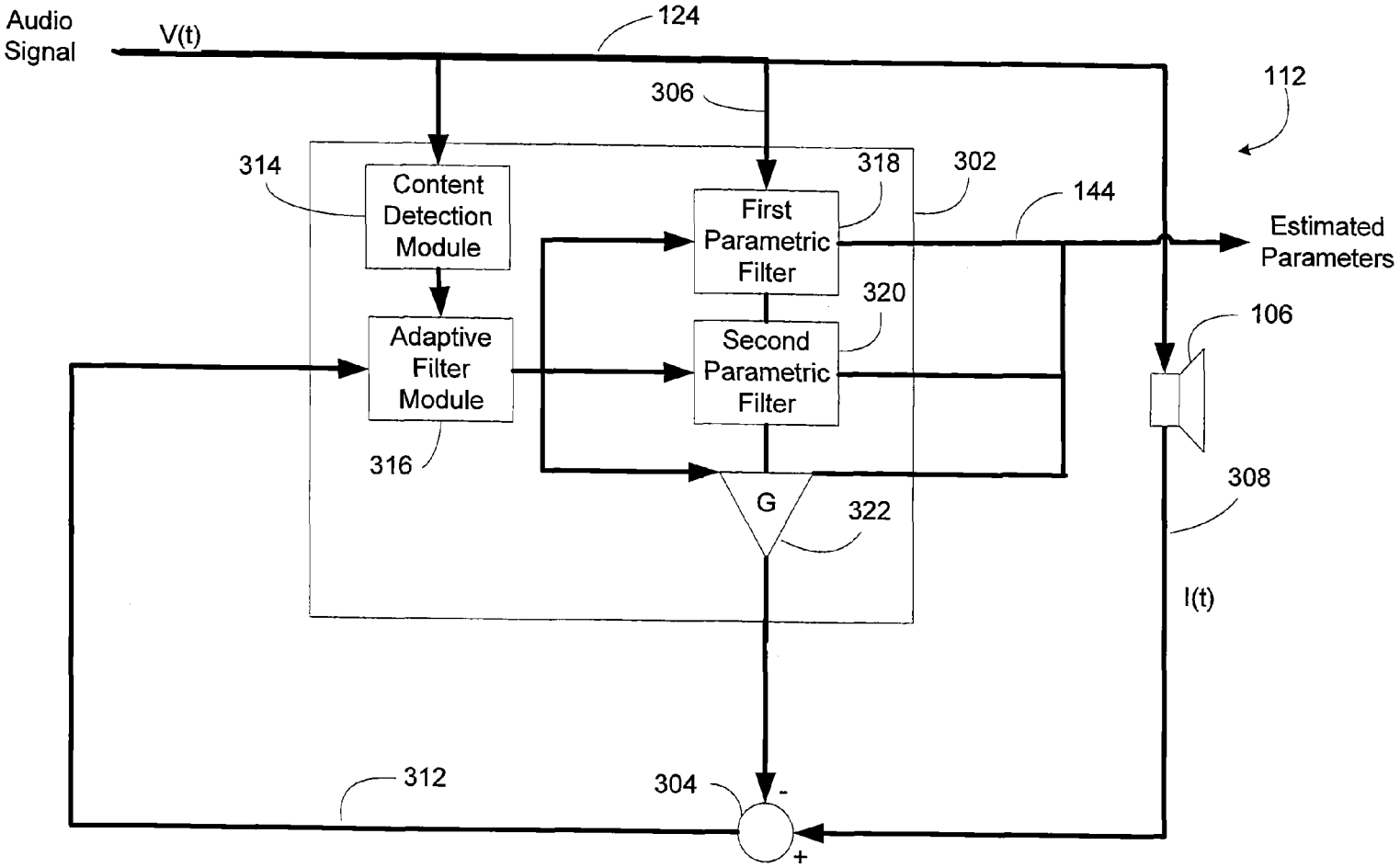
FIG. 3 is an example block diagram of a parameter computer included in the power management system of FIG. 1.

FIG. 3 is an example block diagram of the parameter computer 112 that includes a real-time parameter estimator 302 and a summer 304. An audio signal is provided from an audio source on the audio source line 124, which is used to drive the loudspeaker 106. In this example, the parameter computer 112 receives samples of the real-time actual voltage V(t) of the audio signal (conditioned or unconditioned) on a real-time actual voltage line 306. If the voltage is received via a digital to analog converter (DAC), the voltage may not be an actual voltage. Rather, the "actual" voltage may be an estimated voltage based on DAC voltage. In addition, the parameter computer 112 receives samples of the real-time actual current I(t) representative of the current received at the loudspeaker 106 (conditioned or unconditioned) on a real-time current line 308.

The real-time parameter estimator 302 may be used in building a digital model of a device, such as the loudspeaker 106 by comparison of the real-time actual current I(t) to an estimated real-time current using the summer 304. The comparison may occur each time a number of samples are received, on a sample-by-sample basis, or any other period of time that will provide real-time values as outputs. The estimated real-time current may be calculated by the real-time parameter estimator 302 based on the real-time actual voltage V(t). In FIG. 3, the estimated real-time current calculated by the real-time parameter estimator 302 may be subtracted from the real-time actual current I(t) to produce an error signal on an error signal line 312. Alternatively, an estimated real-time voltage may be calculated by the real-time parameter estimator 302 based on the real-time actual current I(t), and compared to the actual real-time voltage to generate the error signal on the error signal line 312. The real-time parameter estimator 302 may perform the calculations using filters that model the device parameters, such as speaker parameters, to arrive at an estimated real-time voltage or current.

In one example, the modeling performed with the real-time parameter estimator 302 may be load impedance based modeling using an adaptive filter algorithm that analyzes the error signal and iteratively adjusts the estimated speaker parameters as needed to minimize the error in real-time. In this example, the real-time parameter estimator 302 may include a content detection module 314, an adaptive filter module 316, a first parametric filter 318, a second parametric filter 320, and an attenuation module 322. The real-time actual voltage V(t) of the audio signal may be received by the first parametric filter 318 on a sample-by-sample basis. The real-time actual current I(t) may similarly be received by the summer 304 on a sample-by-sample basis.

Accordingly, the adaptive filter module 316 may use the adaptive filter algorithm to analyze the error signal and iteratively and selectively adjust filter parameters in each of first and second parametric filters 318 and 320 to minimize the error. The algorithm executed by the adaptive filter module 316 may be any form of adaptive filtering technique, such as a least mean squares (LMS) algorithm, or a variant of an LMS algorithm.

The content detection module 314 may enable operation of the adaptive filter module 316 so that the adaptive filter module 316 does not operate when content included in the audio signal is not within predetermined boundaries. For example, the adaptive filter module 316 may be disabled by the content detection module 314 when only noise is detected in the audio signal so that stability of the adaptive filter module 316 is not compromised.

The content detection module 314 may detect an energy level of content included in the audio signal within a predetermined frequency range or bandwidth. The predetermined frequency range may be based on estimated and/or actual operational characteristics the loudspeaker 106. In one example, the predetermined frequency range may be from about zero hertz to a determined maximum frequency, such as a maximum possible estimated real-time resonance frequency of the loudspeaker 106. In other examples, the frequency range may be from zero hertz to the manufacturer's advertised resonance frequency of the loudspeaker 106. In still other examples, any other range of frequency may be applied as the predetermined frequency range. Detection of the energy level may be based on a predetermined energy level limit, such as a minimum energy level capable of being processed by the adaptive filter module 316. In one example, the minimum energy level may be a minimum level of RMS voltage present in the audio signal.

Once enabled by the content detection module 314 based on the audio signal being within the predetermined boundaries, operation of the adaptive filter module 316 may continually solving to prevent local minimums in order be relatively quick and robust at converging any error between the estimated real-time parameter and the measured actual parameter to a predetermined level of error. The adaptive filter may continually solve during operation of the audio system to minimize error or it may be part of a multiplexed system where the algorithm adapts with some duty cycle. Operation of the adaptive filter module 316 may be seeded with initial values such as the design parameters of the speaker, the last known values from the algorithm, or a computed estimate of the parameters based on information supplied from one or more external sources, such as a reading from an ambient temperature sensor for example.

The initial filter values included in the first parametric filter 318, the second parametric filter 320, and the attenuation module 304 may be predetermined values previously selected in order to create a model of the loudspeaker 106 that approximates actual real-time operational characteristics of the loudspeaker 106. The predetermined values may be stored in the respective filters and module, in the adaptive filter module 316, in the parameter computer 112 or any other data storage location associated with the parameter computer 112. The predetermined values can be based on testing of a representative loudspeaker 106, testing of the actual loudspeaker 106 under lab conditions, last known operational values of the first parametric filter 318, the second parametric filter 320, and the attenuation module 322 from previous operation of the real-time parameter estimator 302, a calculation based on an ambient temperature reading, or any other mechanism or procedure to obtain values that will allow the error (or differences) between the actual operational characteristics of the loudspeaker 106 and the estimated operational characteristics of the loudspeaker 106 to quickly converge to about zero or a predetermined acceptable level. However, the real-time parameter estimator 302 may include parameters to control how quickly the estimated operational characteristics are adjusted or evolved as the real-time actual values change. In one example, the estimated speaker parameters may evolve significant slower than the audio signal changes, for example one hundred microseconds to two seconds slower than changes in the audio signal based on sampling the audio signal at a predetermined rate.

The first and second parametric filters 318 and 320 may be any form of filter that can be used to represent or model all or some portion of operating parameters of a loudspeaker. In other examples, a single filter may be used to represent or model all or some portion of operating parameters of a loudspeaker. In one example, the first parametric filter 318 may be a parametric notch filter, and the second parametric filter 320 may be a parametric low-pass filter. The parametric notch filter may be populated with changeable filter parameter values, such as a Q, a frequency and a gain, to model loudspeaker admittance near a resonance frequency of the loudspeaker in real-time. The parametric low-pass filter may be populated with changeable filter parameter values, such as a Q, a frequency and a gain, to model loudspeaker admittance in a high frequency range of the loudspeaker. In an alternative example, the second parametric filter 320 may be omitted. Omission of the second parametric filter 320 may be due to the frequency range of the loudspeaker being modeled not needing such characteristics modeled, due to use of constant predetermined filter values to model loudspeaker admittance in a high frequency range of the loudspeaker, use of a constant to model loudspeaker admittance in a high frequency range of the loudspeaker, or any other reason that eliminates the need for the second parametric filter 318.

The attenuation module 322 may be populated with a gain value to model DC admittance of the loudspeaker 106. The gain value may be varied to account for DC offset in a value of the inductance of the loudspeaker. For example, in a nominally four ohm loudspeaker, the gain value may be about 0.25. Thus, as the real-time actual impedance of the loudspeaker 106 varies during operation, the gain value of the attenuation module 322 may be correspondingly varied in real-time to maintain an accurate estimate of the operational characteristics of the loudspeaker 106. In one example, the attenuation model 322 may provide modeling of a DC offset in the admittance modeled by the second parametric filter. For example, as the error signal begins to flatten (converge) due to iterative real-time adjustments to the changeable values of the first parametric filter 318 and the second parametric filter 320, the gain value of the attenuation module 322 may be adjusted by the adaptive filter module 316 to converge the error toward zero.

The estimated real-time parameters, such as estimated real-time speaker parameters may be provided on the estimated operational characteristics line 144. Since the real-time parameter estimator 302 is directly developing the speaker parameters in real-time using parametric filters, curve fitting of filter parameters to obtain the speaker parameters is unnecessary. In addition, due to the continual solving to converge the error signal to substantially zero, if, for example, the actual characteristics of the loudspeaker vary during operation to the point where the resonance frequency has changed iterative adjustment of the changeable values in the first parametric notch filter 318 may occur to move the estimated center frequency included in the estimated operational characteristics to substantially match the actual resonance frequency of the loudspeaker 106.

Figure 4:
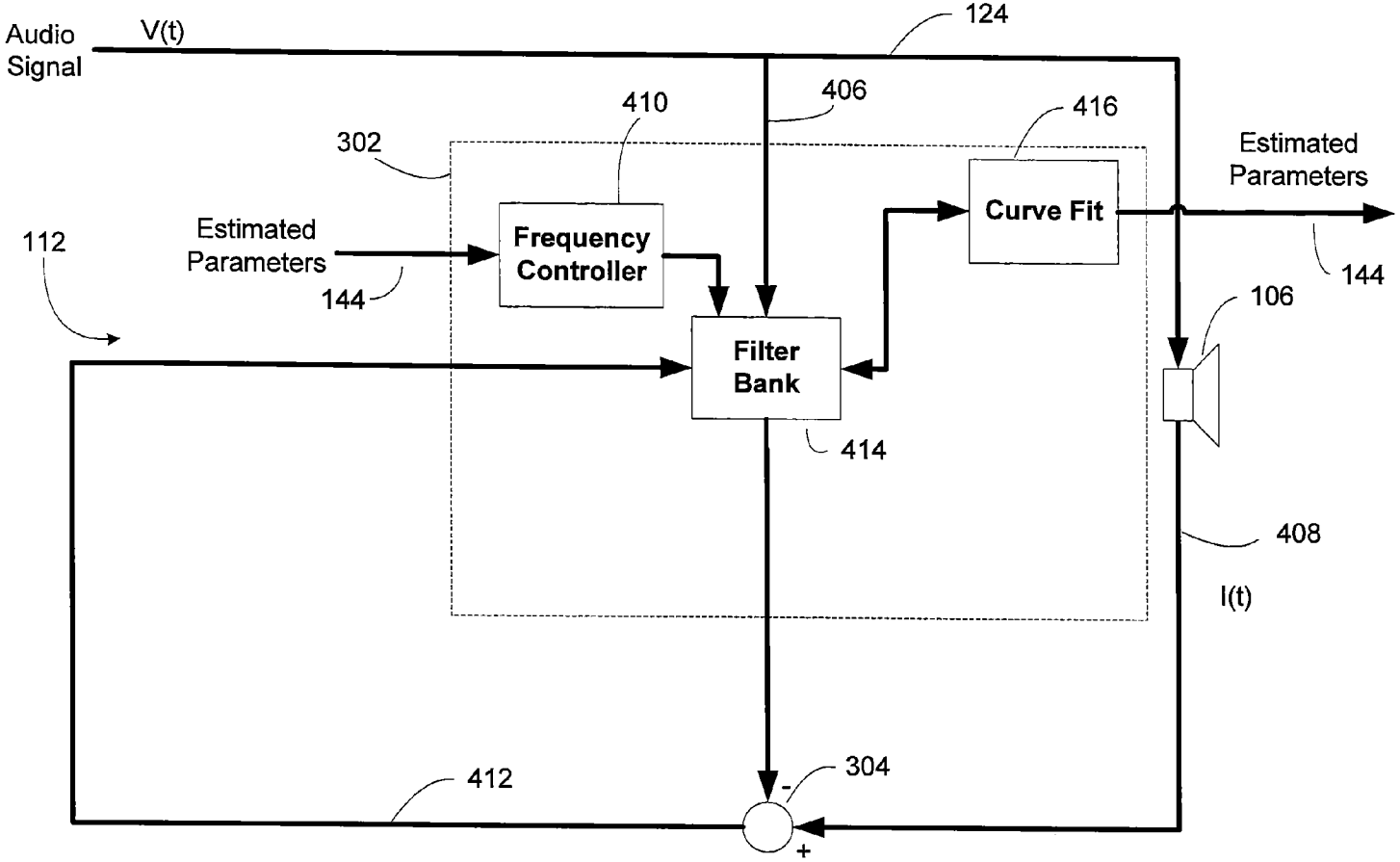
FIG. 4 is another example block diagram of the parameter computer included in the power management system of FIG. 1.

FIG. 4 is another example block diagram of the parameter computer 112 containing the real-time parameter estimator 302 and the summer 304. An audio signal may be provided from an audio source on the audio source line 124, which is used to drive the loudspeaker 106. Similar to FIG. 3, the parameter computer 112 may receive samples of the real-time actual voltage V(t) of the audio signal (conditioned or unconditioned) on a real-time actual voltage line 406. In addition, the parameter computer 112 may receive samples of the real-time actual current I(t) representative of the current received at the loudspeaker 106 (conditioned or unconditioned) on a real-time current line 408. Also, the summer 304 may output a real-time error signal on an error signal line 412 representative of differences between the real-time actual current I(t) and a real-time estimated current. In other examples, the real-time error signal may represent the difference between the real-time actual voltage V(t) and a real-time estimate voltage. Due to the many similarities with the example parameter computer 112 of FIG. 3, for purposes of brevity, and to avoid repetition, the following discussion will focus mainly on differences between these two examples.

In FIG. 4, the real-time parameter estimator 302 may include a frequency controller 410, a filter bank 414, and a curve fit module 416. The frequency controller 410 may receive estimated speaker parameters from the parameter computer 112, such as a real-time estimated resonance frequency of the loudspeaker 106. Based on the estimated speaker parameters, the frequency controller 410 may provide updated filter parameters to the filter bank 414. The filter bank 414 may include a plurality of filters such that two filters cooperatively operate at one frequency. The two filters include a first filter for the voltage at that frequency, and a second filter for the current at that frequency. To get an impedance value at the frequency where a respective pair of filters is positioned, the results from the two filters are divided. Accordingly, each of the pairs of filters may provide one impedance value for one frequency, and it is a plurality of impedance values from the plurality of filters that may be populated with updated filter parameters in real-time to reflect an estimated impedance model for the loudspeaker 106. In one example, each of the filters may be a discrete Fourier transform. In another example, each of the filters may be a Goertzel filter operating at a predetermined frequency.

Since each of the filters in the filter bank 414 converges to a different frequency ranging from about 20 Hz to 20 kHz, a speaker operational characteristic in the form of an impedance value for a single frequency may be derived by minimizing the error on the error line 412 at that single frequency. By minimizing the error in each of a plurality of the filters in the filter bank 414, an estimated speaker impedance curve may be generated in real-time. Specifically, the error signal may be converged by iteratively adapting the filter parameters of the filters to obtain a frequency response curve with a shape substantially similar to a loudspeaker admittance. Following convergence, the curve fit module 416 may be executed to convert the filter parameters, which represent a set of admittance or impedance data points each being at different frequencies, to estimated operational characteristics of the loudspeaker 106 in the form of estimated speaker parameters. The estimated speaker parameters may be provided to the one or more threshold comparators 114 on the estimated operational characteristics line 144. In addition, any other estimated operational characteristics may be supplied by the speaker parameters computer 112 to the threshold comparators 114 on the estimated operational characteristics line 144.

Since each of the filters are operated at single frequency, there is no need for adaptive filtering as discussed with regard to FIG. 3. In addition, the level of computing power needed to converge the error signal is significantly less than the computing power needed with a Fast Fourier Transform (FFT) solution. For example, audio content in the form of a song may be provided on the audio signal line 406, and one of the filters may ascertain the magnitude of energy in the audio signal at a selected frequency, such as 80 Hz.

In one example, the bank of filters included in the filter bank 414 may be distributed in a range of frequencies from about 20 Hz to about 20 kHz at one third octaves to accurately provide a sample of the frequency data. In another example, the filters within the filter bank may be distributed in predetermined locations, such as where the majority of the filters may be strategically positioned in a desired location, such as in the vicinity of the estimated resonance frequency of the loudspeaker 106, while fewer filters may be distributed across the frequency range to capture the range of frequencies. Since the frequencies upon which the filters in the filter bank operate may be changed by changing the frequency parameter of individual filters in the filterbank 414, the filters may be arrange within the frequency range so as to be placed at strategic locations useful in building an accurate estimate of the operational characteristics of the loudspeaker 106.

The frequency parameters of individual filters may be changed manually by a user, automatically by the system, or some combination of manual and automatic to obtain desired locations of the filters along a frequency spectrum. For example, a user could group filters and make manual changes to the frequency of all of the filters in the group. Alternatively, the parameters computer 112 may detect an estimated resonance of the loudspeaker, as discussed later, and adjust the filter frequencies accordingly in order to optimize frequency resolution around the estimated resonance. In one example, the frequencies of the filters may be stored predetermined values. In another example, the frequencies may be dynamically updated in real-time by the parameter computer 112 as the estimated and actual operational characteristics, such as the resonance frequency, of the loudspeaker 106 vary during operation. In still another alternative, the parameter computer 112 may provide the frequencies on a predetermined time schedule, and/or in response to a predetermined percentage change in the estimated real-time operational characteristics of the loudspeaker 106.

Figure 5:
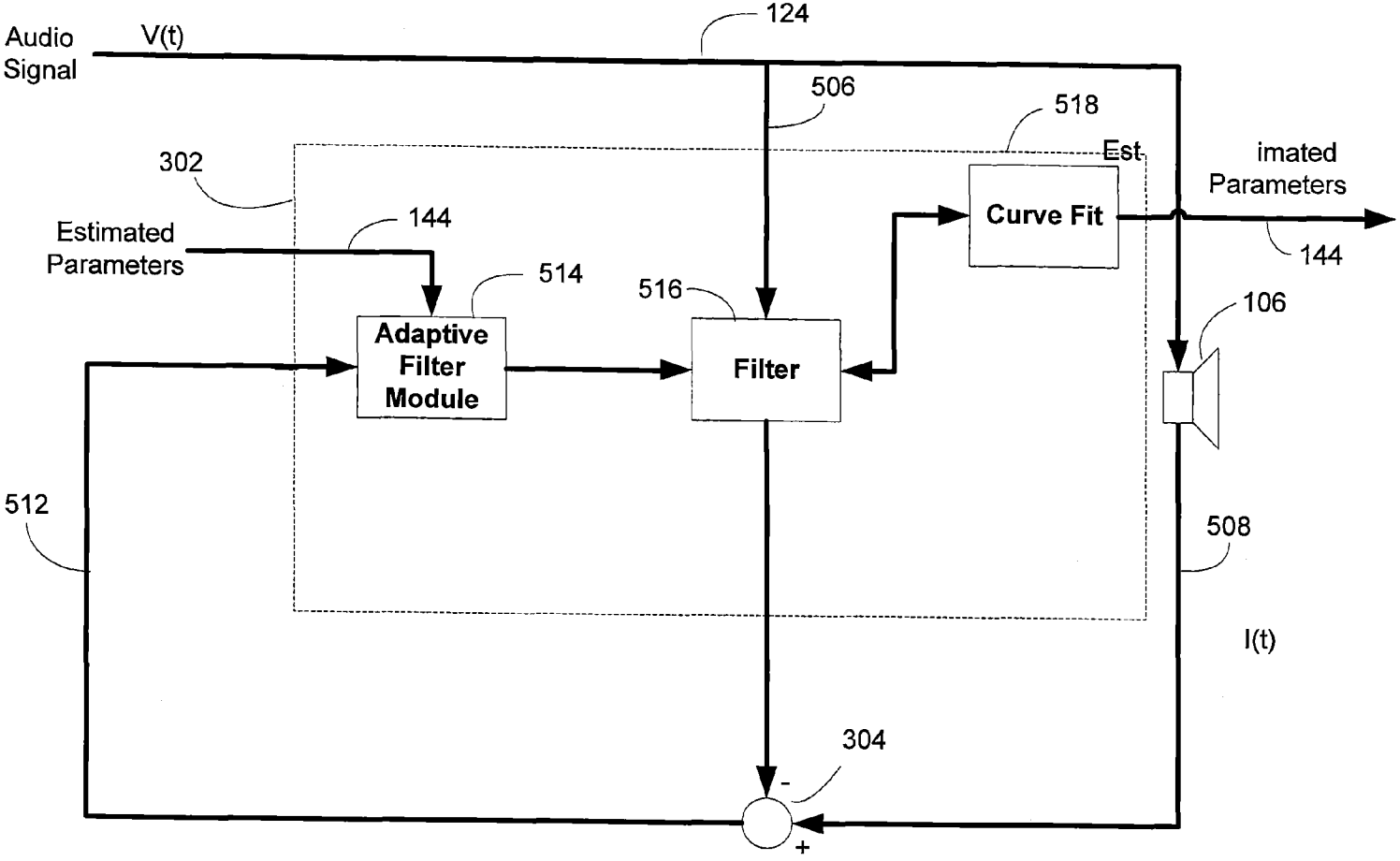
FIG. 5 is another example block diagram of the parameter computer included in the power management system of FIG. 1.

FIG. 5 is another example block diagram of the parameter computer 112 that includes the real-time parameter estimator 302 and the summer 304. Similar to the previous examples, an audio signal is provided from an audio source on the audio source line 124, which is used to drive the loudspeaker 106. In addition, a real-time actual voltage V(t) (conditioned or unconditioned) is provided to the real-time parameter estimator 302 from the audio signal supplied on a real-time actual voltage line 506. In addition, the summer 304 may similarly receive a real-time actual current I(t) (conditioned or unconditioned) supplied on a real-time current line 508. The summer 304 may output an error signal representative of a difference in a measured actual parameter and an estimated real-time parameter in order to adjust an estimated speaker model indicative of estimated real-time operational characteristics of the loudspeaker 106. The error signal may be output by the summer 304 on an error signal line 512 to the real-time parameter estimator 302. Since this example is similar in many respects to the previously discussed examples of the power management system 100 and audio system of FIGS. 3 and 4, for purposes of brevity such information will not be repeated, rather the discussion will focus on differences from the previously discussed examples.

In FIG. 5, the real-time parameter estimator 302 includes an adaptive filter module 514, a non-parametric filter 516, and a curve fit module 518. In this example, the adaptive filter module 514 may analyze the error signal and adjust filter parameters in the non-parametric filter 516 in real-time. The non-parametric filter 516 may be a finite impulse response (FIR) filter, or any other form of filter having a finite number of coefficients that is capable of modeling estimated operational characteristics of the loudspeaker 106 of another device in the audio system. By adaptive iteration of the coefficients in the non-parametric filter 516, the error signal may be minimized in real-time. The rate of adaptation of the non-parametric filter 516 may be controlled by the adaptive filter module 514 so that evolution of the filter coefficients occurs relatively slowly with respect to the number of samples received. For example, iterative adaptation of the filter coefficients may occur in a range of 100 milliseconds to 2 seconds when compared to the rate of change of the audio signal.

The filter coefficients may be representative of a real-time estimate of an admittance of the loudspeaker 106 over a range of frequencies, such as from 20 Hz to 20 kHz. From the estimated admittance, estimated speaker parameters such as DC resistance, moving mass, resonance frequency, and inductance of the loudspeaker may be derived in real-time. Since the coefficients developed for the non-parametric filter 516 to estimate the operational characteristics of the loudspeaker 106 are not in a human readable form, the curve fit module 518 may be applied to fit the coefficients to a curve in order to obtain the estimated speaker parameters. Conversion of the filter coefficients to estimated speaker parameters allows use of the speaker parameters within the audio power management system 100. The speaker parameters may be provided to the one or more threshold comparators 114 on the estimated operational characteristics line 144. In addition, any other estimated operational characteristics may be supplied by the speaker parameters computer 112 to the threshold comparators 114 on the estimated operational characteristics line 144.

In FIG. 1, the threshold comparators 114 may be selectively included in the power management system 100 to provide some form of management of operation of the loudspeaker 106, the amplifier 104, the audio source 102, or any other component in the audio system. Management of operation may entail some form of protection of the loudspeaker 106, the amplifier 104 and/or the audio source 102 from damage or other operation detrimental to the physical stability of the respective device, or other devices within the audio system. Alternatively, or in addition, management of operation may entail some form of operational control to minimize undesirable operation of the loudspeaker 106, the amplifier 104 and/or the audio source 102 such as to minimize distortion or unneeded clipping. In addition, overall power consumption by the audio system, or individual components/devices within the audio system, may be minimized by adhering to power consumption targets or limits.

The threshold comparators 114 may use estimated parameters, such as speaker parameters developed by the parameter computer 112 along with real-time actual voltages V(t) (conditioned or unconditioned) and/or real-time actual currents I(t) (conditioned or unconditioned) to provide management of operation of the loudspeaker 106 and/or other devices in the audio system. Management of the devices may be based on development and application of one or more thresholds. The thresholds developed and applied by the threshold comparators 114 may be based on any combination of the real-time actual measured values, estimated parameters, limit values, and/or boundaries. In other words, the thresholds may be developed as a result of changing real-time operational characteristics and changing real-time calculation of limits or boundaries of one or more of the devices included in the audio system.

The parameter computer 112 may provide the estimated speaker parameters in real-time on the estimated operational characteristics line 144. In addition, the real-time actual voltage V(t), and/or the real-time actual current I(t) may be provided to the threshold comparators 114 on the real-time actual voltage line 140 and the real-time actual current line 138. The estimated speaker parameters, and the measured actual parameters may be provided to the threshold comparators 114 on a predetermined schedule, such as on a sample-by-sample basis, iteratively after a predetermined number of samples, or any other period of time that enables real-time calculation and/or application of limit values in order to develop and implement one or more thresholds. Development of the thresholds may include consideration of audio system operational parameter limits and/or audio system protection parameter limits. Accordingly, the audio power management system 100 may provide an equipment protection function, a power conservation function, and an audio sound output control function.

In that regard, following determination of threshold audio system operational parameters in real-time, the threshold comparators 114 may monitor on a real-time basis for the measured parameters to cross or reach the respective determined thresholds. Upon detecting in real-time that a respective threshold has been crossed, the respective threshold comparator 114 may independently provide a respective limiting signal to the limiter 116 on a respective limiter signal line 154.

The limiter 116 may be any form of control device capable of adjusting the audio signal being provided on the audio signal line 124. The limiter 116 may be triggered to adjust the audio signal in response to receipt of one or more limiting signals. As described later, the adjustments to the audio signal may be based on the particular threshold detector providing the limiting signal and/or the nature of the limiting signal being provided. The limiter 116 may operate as a digital device, such as within a digital signal processor. Alternatively or in addition, the limiter 116 may be an analog device and/or composed of electronic circuits and circuitry. Also, alternatively, or in addition, the limiter 116 may control a gain or some other adjustable parameter of the power amplifier 104, the audio source 102, or any other component in the audio system in response to receipt of one or more limiting signals.

The limiter 116 may also include stored parameters for use with one or more of the limiting signals to adjust the audio signals. Example parameters include an attack time, a release time, a threshold, a ratio, an output signal level, a gain, or any other parameters related to adjusting the audio signal. In one example, different stored parameters may be used by the limiter 116 in limiting the audio signal depending on the limiting signal, and/or the threshold comparator 114 providing the limiting signal. Accordingly, each of the threshold comparators 114 may provide limiting signals that include information identifying the type of limiting signal and/or the one of the threshold comparators 114 from which the limiting signal was produced. For example, the limiter 116 may include input mapping that corresponds to the threshold comparators 114 such that limiting signals received on a particular input are known by the limiter 116 to be from a particular one of the threshold comparators 114 based on the input mapping. In another example, the limiting signals may include an identifier of the respective threshold comparator 114 transmitting the respective limiting signal. In addition, or alternatively, each of the different limiting signals may include an action identifier indicating what action the limiter 116 should take upon receiving a particular type of limiting signal. The action identifier may also include parameters, such as gain values or other parameters to use in limiting or otherwise adjusting the audio signal or a device in the audio system.

Operation by the limiter 116 to adjust the audio signal may be performed in real-time based on limiting signals provided from the threshold comparators 114. The limiter 116 may also operate to adjust the audio signal in real-time in response to limiting signals from two or more different threshold comparators 114. In one example, such adjustments responsive to different limiting signals from different threshold comparators 114 may be performed at substantially the same time to adjust the audio signal.

The compensation block 118 may also optionally be included in the audio power management system 100. The compensation block 118 may be any circuit or algorithm providing phase delay, time delay, and/or time shifting to allow real-time operation of the limiter 116 without distortion of the audio signal. As described later, the compensation block 118 may also cooperatively operate with the individual threshold comparators 114 to perform different types of compensation of the audio signal dependent on the nature of the limiting signal being provided by a particular threshold comparator 114. In addition or alternatively, the compensation block 118 may be selectively activated and deactivated based on the limiting signal being provided by a respective threshold comparator 114. The compensation block 118 may also be selectively adjusted based on estimated operational characteristics of the loudspeaker 106 provided by the parameter computer 112.

In FIG. 1, the threshold comparators 114 may include any one or more of a voltage threshold comparator 146, a current threshold comparator 148, a load power comparator 150 and a speaker linear excursion comparator 152. In other examples only one, or any sub-combination, of the above-identified threshold comparators 114 may be included in the audio power management system 100. In still other examples, additional or alternative threshold comparators, such as a sound pressure level comparator, or any other form of comparator capable of developing a threshold to manage operation of one or more components of the audio system may be included in the audio power management system 100.

Figure 6:
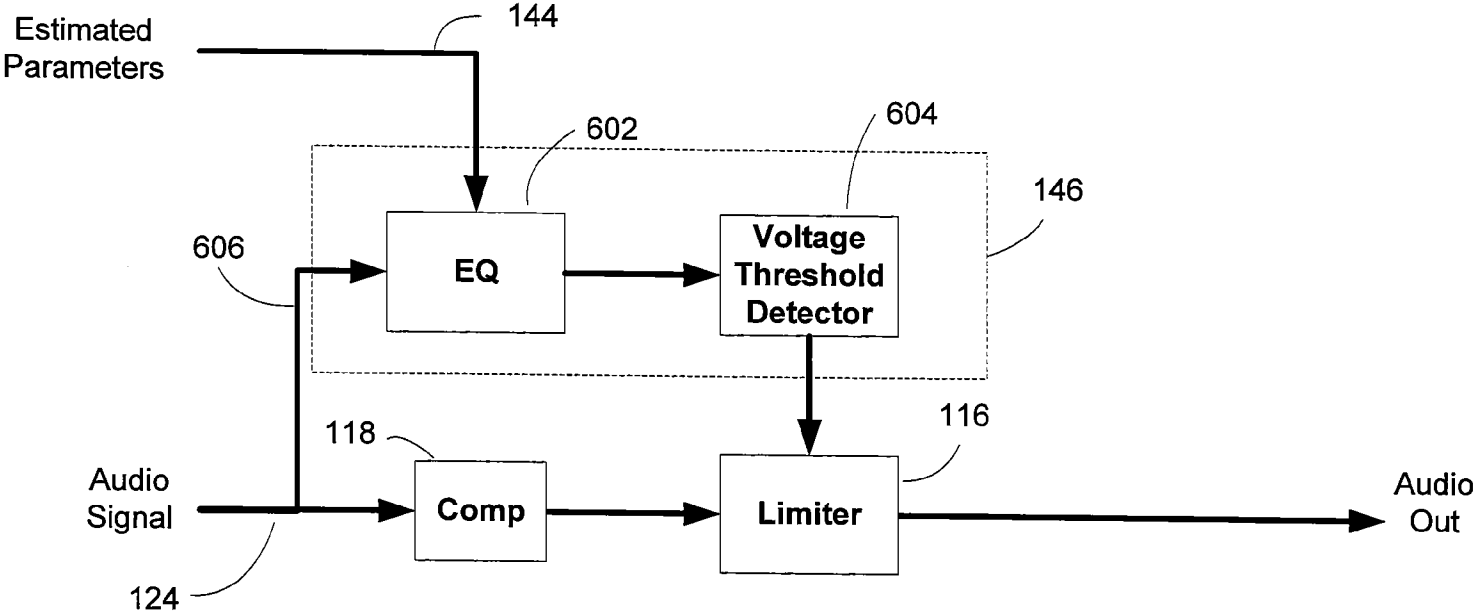
FIG. 6 is an example block diagram of a voltage threshold comparator included in the power management system of FIG. 1.

FIG. 6 is a block diagram example of a voltage threshold comparator 146, the limiter 116, and the compensation block 118. The voltage threshold comparator 146 may include an equalization module 602 and a voltage threshold detector 604. The audio signal may be supplied to the compensation block 118 on the audio signal line 124. In addition, the real-time actual voltage V(t) (conditioned or unconditioned) of the audio signal may be supplied to the equalization module 602 on a real-time actual voltage line 606. In this example, the compensation block 118 may operate as a phase equalizer to maintain the phase consistently between the sensed voltage signal and the audio signal during operation of the voltage threshold comparator 146 to prevent overshoot in the audio signal due to phase lag in the signals passing through 146.

In FIG. 6, the equalization module 602 may operate based on not only the real-time actual voltage V(t), but also based on estimated real-time operational characteristics provided from the parameter computer 112 on the speaker parameters line 144. In one example, the estimated real-time operational characteristics may be a stored predetermined value. In another example, the estimated real-time operational characteristics may be dynamically updated in real-time by the parameter computer 112 as the estimated and actual operational characteristics of the loudspeaker 106 vary during operation. In still another alternative, the parameter computer 112 may provide the estimated real-time operational characteristics on a predetermined time schedule, and/or in response to a predetermined percentage change in the estimated real-time operational characteristics.

The equalization module 602 may include a filter, such as narrow band all pass filter, a peak notch filter, or any other filter capable of modeling the resonance of a loudspeaker. The filter may include adjustable filter parameters, such as a Q, a gain, and a frequency. The filter parameters of the filter may be varied by the equalization module 602 as the estimated real-time operational characteristics such as a real-time estimated resonance frequency, of the loudspeaker 106 varies. Variations in the filter may adjust a magnitude of signal energy in certain frequencies such that at some frequencies the real-time actual voltage V(t) of the audio signal is attenuated, while at other frequencies the real-time actual voltage V(t) is accentuated. The variations in the filter may occur on a sample-by-sample basis, every predetermined number of samples, or at any other time period.

The resulting output of the equalization module 602 is a filtered or equalized real-time voltage signal in the frequency domain that has been compensated based on the real-time estimated resonance frequency of the loudspeaker 106. The filtered real-time actual voltage V(t) may be provided as a compensated real-time voltage signal on a compensated voltage line 606 to the voltage threshold detector 604.

The voltage threshold detector 604 may determine if thresholds are exceeded at any of a predetermined number of frequencies based on the compensated real-time voltage signal. A loudspeaker is capable of handling relatively large magnitudes of voltage in an audio signal near the resonance frequency of the loudspeaker, and has relatively lower voltage magnitude handling capability further away from the resonance frequency. The compensation by the equalization module 602 reflects the varying voltage handling capability of the loudspeaker 106 within the frequencies as the estimated resonance frequency of the loudspeaker 106 changes during operation.

The speaker parameter computer 112 may provide a continuous frequency based boundary curve that is provided as a limit for the voltage threshold detector 604 to use in developing the threshold. The boundary curve may initially be a stored curve that may be adjusted in realtime by the parameter computer 112 based on the real-time actual measured values and/or the estimated real-time operational characteristics. The parameter computer 112 may provide the adjusted boundary curve to the voltage threshold detector 604 on a predetermined time schedule, and/or in response to a predetermined percentage change in the boundary curve. Alternatively, the stored boundary curve may be provided to the voltage threshold detector 604 for use by the voltage threshold detector. In addition, or alternatively, the voltage threshold detector 604 may adjust the received boundary curve in real-time based on the received real-time actual voltage V(t), and the estimated real-time operational characteristics. When the voltage threshold detector 604 identifies a signal level of the filtered real-time actual voltage V(t) that exceed the boundary curve the threshold determined by the voltage threshold detector 604 is exceeded. In response, a corresponding limiting signal may be generated by the voltage threshold detector 604 and provided to the limiter 116. Based on the particular limiting signal provided, the limiter may take a pre-specified action. For example, dependent on the particular limiting signal, the limiter 116 may perform gain reduction or clipping of the audio signal. As such, using the real-time estimated resonance frequency of the loudspeaker 106, distortion and/or physical damage of the loudspeaker may be minimized. Moreover, efficient operation may be optimized, which optimizes energy efficiency, due to frequency based consideration of the real-time actual voltage V(t) based on an estimated real-time resonance frequency of the loudspeaker 106. Using this approach, the equalization module 602 can develop and provide a varying, frequency sensitive filtered voltage signal to the voltage threshold detector 604.

Figure 7:
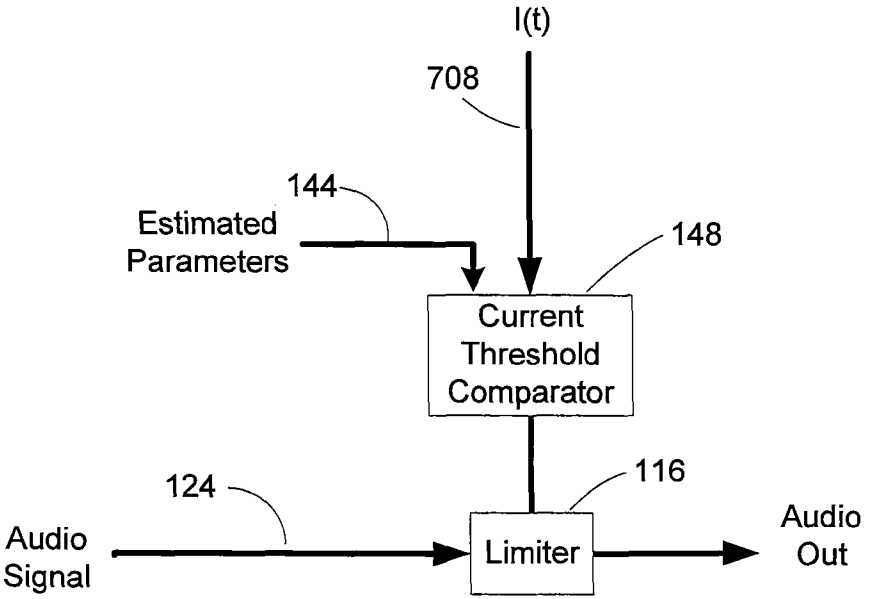
FIG. 7 is an example block diagram of a current threshold comparator included in the power management system of FIG. 1.

FIG. 7 is an example block diagram of the current threshold comparator 148 and the limiter 116. The real-time actual current I(t) (conditioned or unconditioned) may be supplied to the current threshold comparator 148 on a real-time actual current line 708. The current threshold comparator 148 may develop a threshold by comparison of the real-time actual current I(t) to an audio system boundary parameter, such as an audio system protection parameter. The audio system boundary parameter may be a stored value of current, which is not dynamically changed during operation of the audio power management system 100. Alternatively, the audio system boundary parameter may be a changeable boundary value. In one example, the audio system boundary parameter may be a derived estimated real-time parameter, such as an estimated real-time current derived by the parameter computer 112 based on a measured actual parameter, such as the real-time actual voltage V(t) and an estimated real-time impedance of the loudspeaker 106. The estimated real-time current may be used by the current threshold comparator 148 in developing and applying the threshold. In other examples, the estimated boundary value may be derived by the current threshold comparator 148 from all estimated values, tables, and/or any other means to develop the threshold.

The derived estimated real-time parameter, may be provided on the estimate operational characteristics line 144 to the current threshold comparator 148. In other examples, the threshold audio system parameter may be any other estimated real-time parameter provided from the parameter computer 112, which may be used by the current threshold comparator 148 to derive a threshold. For example, an estimated real-time voltage and an estimated real-time impedance may be provided to the current threshold comparator 148 by the parameter computer 112 to allow the current threshold comparator 148 to derive an estimated real-time current. In one example, the estimated real-time parameter(s) may be a stored predetermined value. In another example, the estimated real-time parameter(s) may be dynamically updated in real-time by the parameter computer 112 as the estimated and actual operational characteristics of the loudspeaker 106 vary during operation. In still another alternative, the parameter computer 112 may provide the estimated real-time parameter(s) on a predetermined time schedule, and/or in response to a predetermined percentage or degree of change in the estimated real-time parameter(s).

During operation, when the threshold is exceeded based on the real-time actual current I(t) (conditioned or unconditioned) of the audio signal, the current threshold comparator 148 may output a limiting signal to the limiter 116. The limiter 116, based on the specific limiting signal provided may act to adjust the audio signal. For example, the limiter may act as a voltage limiter to maintain current in the audio signal below the threshold. Since the real-time actual current I(t) is representative of the current flowing in the loudspeaker 106, operation of the feedback loop represented by the current threshold comparator 148 and the limiter 116 may be fast enough to "catch" a relatively fast rising current in the audio signal prior to causing undesirable operation of the loudspeaker 106. In this regard, the current threshold comparator 148 may also use previously received real-time actual current I(t) samples to interpolate for future samples. In this way, the current threshold comparator 148 may perform a predictive function and provide limiting signals to the limiter 116 to "head off" undesirable levels of current in the audio signal when the threshold is exceeded. In this way, the current threshold comparator 148 may operate to protect loudspeaker operation, such as a woofer loudspeaker that could be low pass filtered at a predetermined frequency, such as about 200 Hz for example. In addition, protection of the amplifier 104 from over current conditions may be accomplished by holding down the current in the audio signal.

Figure 8:
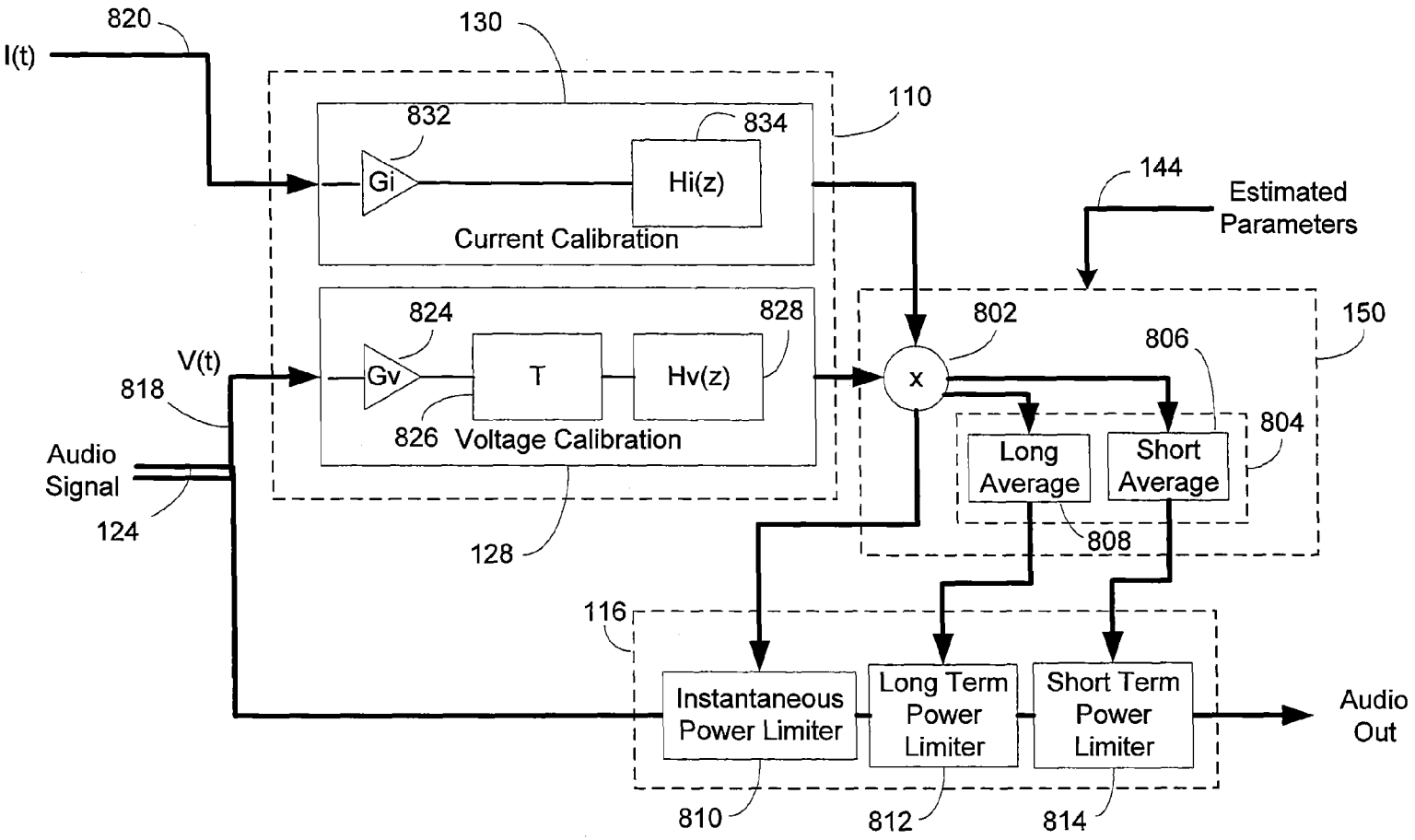
FIG. 8 is an example block diagram of a load power comparator included in the power management system of FIG. 1.

FIG. 8 is an example block diagram of the load power comparator 150 that includes an example of the calibration module 110 and an example of the limiter 116. The load power comparator 150 may include a multiplier 802 and a time averaging module 804 that includes a short average module 806 and a long average module 808. The calibration module 110 may include the voltage calibration module 128 and the current calibration module 130. An audio signal provided on the audio signal line 124 may be provided to the limiter 116. In FIG. 8 the limiter 116 includes an instantaneous power limiter 810, a long term power limiter 812 and a short term power limiter 814.

The real-time actual voltage V(t) of the audio signal may be supplied to the voltage calibration module 128 on a real-time actual voltage line 818. The voltage calibration module 128 may include a voltage gain module (Gv) 824, a voltage time delay module (T) 826 and a voltage signal conditioner Hv(x) 828. Each of the voltage gain module 824, the voltage time delay module 826 and the voltage signal conditioner 828 may include pre-stored predetermined settings to calibrate the real-time actual voltage V(t) signal. The real-time actual voltage V(t) signal may be calibrated with the voltage calibration module 128 by applying a predetermined gain with the voltage gain module 824 to scale the voltage, a delay with the voltage time delay module 826 by applying a time delay or time shift, and correcting for response variations with the voltage signal conditioner 828. In other examples, the parameters in the voltage gain module 824, the voltage time delay module 826 and the voltage signal conditioner 828 may be developed and adjusted in real-time by the parameter computer 112.

The real-time actual current I(t) may be supplied to the current calibration module 130 on a real-time actual current line 820. In FIG. 8 the current calibration module 130 includes a current gain module 832 and a current signal conditioner (Hi(z)) 834. The real-time actual current I(t) signal may be calibrated with the current calibration module 130 by applying a predetermined gain with the current gain module 832 to scale the current and correct for response variations with the current signal conditioner 834. In other examples, the parameters in the current gain module 832 and the current signal conditioner 834 may be developed and adjusted in real-time by the parameter computer 112. In still other examples, one or both of the voltage calibration module 128 and the current calibration module 130 may be omitted. In addition, the voltage calibration module 128 and the current calibration module 130 of FIG. 8 may be applied to condition the real-time actual voltage V(t) and real-time actual current I(t) for the parameter computer 112 or any other of the threshold comparators 114.

In FIG. 8, during operation, the conditioned real-time actual voltage V(t) and the conditioned real-time actual current I(t) may be supplied in real-time to the multiplier 802. The output of the multiplier 802 may be an instantaneous power value (P(t)=V(t)*I(t)) representative of the power output (P(t)) to the loudspeaker 106 in real-time. In other examples, one or neither of the conditioned real-time actual voltage V(t) and the conditioned real-time actual current I(t) may be supplied to the multiplier 802 along with one or more estimated operational characteristics.

Figure 9:
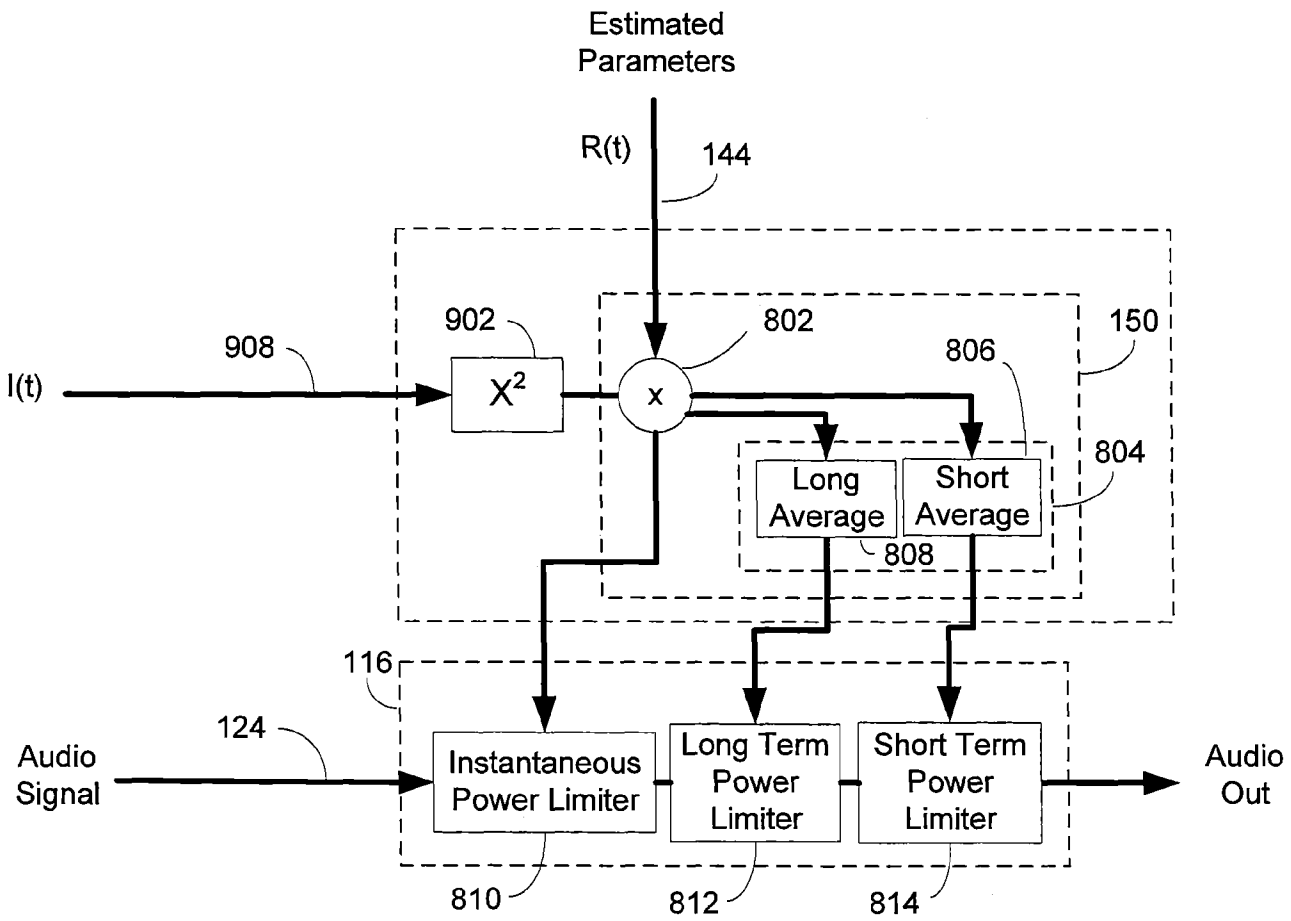
FIG. 9 is another example block diagram of a load power comparator included in the power management system of FIG. 1.

FIG. 9 is a block diagram of another example of the of the load power comparator 150 that includes the limiter 116. The limiter 116 receives the audio signal on the audio signal line 124. In addition, the load power comparator 150 may receive the real-time actual current I(t) (conditioned or unconditioned) on a real-time current line 908, and estimated operational characteristics on the parameter computer line 144. In this example, the estimated operational characteristics may include an estimated speaker parameter in the form of an estimated resistive portion R(t) or real(Z) of a loudspeaker impedance Z(t). In one example, the estimated resistive portion R(t) may be a stored predetermined value. In another example, the estimated resistive portion R(t) may be dynamically updated in real-time by the parameter computer 112 as the estimated and actual operational characteristics of the loudspeaker 106 vary during operation. In still another alternative, the parameter computer 112 may provide the estimated resistive portion R(t) on a predetermined time schedule, and/or in response to a predetermined percentage change in the estimated resistive portion R(t).

Changes in the resistive portion R(t) of the loudspeaker are indicative of heating and cooling of the voice coil in the loudspeaker 106. Increases in the real-time estimated resistance R(t) indicate increasing temperature of the voice coil, and decreasing real-time estimated resistance R(t) indicates decreasing temperature of the voice coil.

In FIG. 9, the load power comparator 150 includes a square function 902, the multiplier 802, and the time averaging module 804. The square function 902 may receive and square the real-time actual current I(t), and provide the result to the multiplier 802 for multiplication with the estimated real-time impedance R(t) of the loudspeaker 106. The result of this operation ($P(t)=I(t)^2*R(t)$) may be provided to the time averaging module 802 in order to derive an estimated instantaneous power value, an estimated short term power value, and a long term power value. It is to be noted that use of the estimated real-time impedance R(t) and the real-time actual current I(t) may provide increased accuracy when compared to use of actual or estimated real-time voltage V(t) and the real-time actual current I(t) to derive the estimated power since voltage drop considerations are unnecessary when estimated real-time impedance R(t) is used to determine power. The difference in accuracy can be significant if the distance between the location of sampling the real-time actual voltage V(t) and the location of the loudspeaker create voltage drop due to line losses.

In FIGS. 8 and 9, the load power comparator 150 may use the instantaneous output power (estimated or actual) from the multiplier 802 to develop a long term average power value and a short term average power value as part of the development and application of thresholds related to output power. Development of the long and short term average power values may be based on a predetermined number of samples of the instantaneous output power that are averaged over time. The number of samples, or the period of time over which the samples are averaged may be from 1 millisecond to about 2 seconds for the short term average power values, and may be from about 2 seconds to about 180 seconds for long term average power values.

The instantaneous power may be compared against a determined instantaneous power limit value by the load power comparator 150 to determine if the derived instantaneous threshold has been eclipsed. In addition, the short term average power values and the long term average power values may be compared against a determined short term limit value and a determined long term limit value to determine if the derived short term threshold and the derived long term threshold have been surpassed. When a respective developed threshold is exceed based on a respective power value, a respective limiting signal may be generated by the load power comparator 150 and provided to the limiter 116. The limiting signals may include an identifier indicating the instantaneous power limiter 810, the short term power limiter 814 or the long term power limiter 812. Alternatively, the limiting signals may be provided as different inputs to the limiter 116 to identify the signals as being designated for the instantaneous power limiter 810, the short term power limiter 814 or the long term power limiter 812. In other examples, any other method may be used to identify the different limiting signals, as previously discussed.

The limit values for comparison to the instantaneous, short term and long term power may be stored predetermined values. Alternatively, the limit values may be dynamically updated in real-time based on estimated operational characteristics provided to the load power comparator 150 from the parameter computer 112 on the estimated operational characteristics line 144. For example, the real-time loudspeaker parameters of the loudspeaker 106 may be used by the load power comparator 150 to derive the limit values as real-time varying values. Alternatively, the limit values may be stored values, or derived in real-time by the parameter computer 112 and provided to the load power computer 150. In still another alternative, the parameter computer 112 may provide the limit values on a predetermined time schedule, and/or in response to a predetermined percentage change in the limit values.

Loudspeakers inherently have thermal time constants regarding the level of heating and cooling, as a function of power input via an audio signal. Since real-time power input to the loudspeaker may be estimated, threshold protection of the loudspeaker from undesirable heating may be avoided. Moreover, threshold protection from such undesirable heating may be achieved, while still allowing maximum operational flexibility due to the real-time or static limit values reflecting the actual acceptable instantaneous, short term, and long term power input ranges for a specific loudspeaker. Use of the real-time actual and estimated parameters to calculate the power and the limit values and determine if the thresholds have been exceeded may account for fluctuations in ambient temperature, variations in manufacturing, and any other factors that affect desirable maximum power thresholds for a specific loudspeaker.

Figure 10:
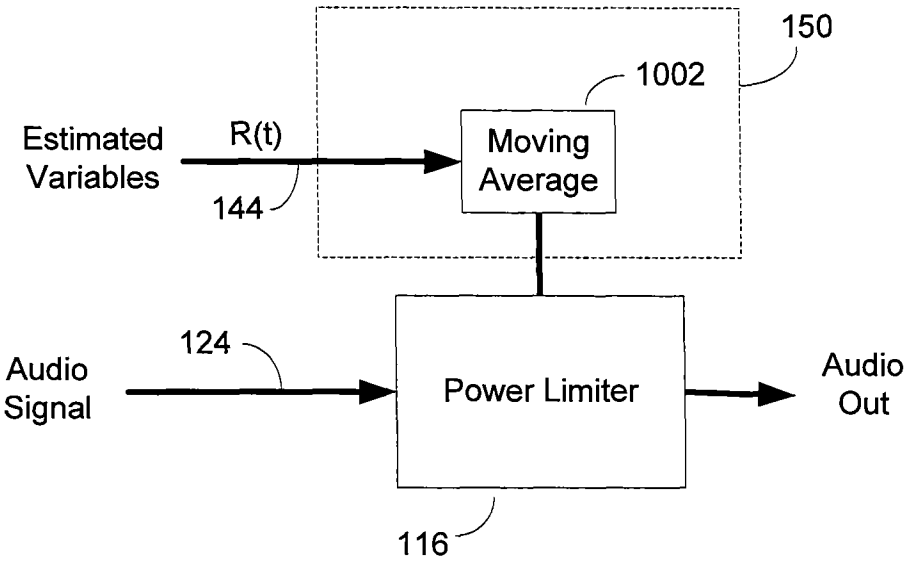
FIG. 10 is yet another example block diagram of a load power comparator included in the power management system of FIG. 1.

FIG. 10 is another example block diagram of the of the load power comparator 150 that includes the limiter 116. The limiter 116 receives the audio signal on the audio signal line 124. In addition, the load power comparator 150 may receive estimated operational characteristics on the parameter computer line 144. In this example, the estimated operational characteristic include an estimated speaker parameter in the form of an estimated resistive portion R(t) or real (Z) of a loudspeaker impedance Z(t). In one example, the estimated resistive portion R(t) may be a stored predetermined value. In another example, the estimated resistive portion R(t) may be dynamically updated in real-time by the parameter computer 112 as the estimated and actual operational characteristics of the loudspeaker 106 vary during operation. In still another alternative, the parameter computer 112 may provide the estimated resistive portion R(t) on a predetermined time schedule, and/or in response to a predetermined percentage change in the estimated resistive portion R(t). Since the load power comparator 150 may operate to develop and apply the thresholds at a relatively slow rate due to calculation of a moving average, the estimated resistive portion R(t) may be sampled at a relatively slow rate.

The load power comparator 150 includes a moving average module 1002. In the case where the estimated resistive portion R(t) is provided on the parameter computer line 144 as a dynamically updated parameter, the moving average module 1002 may receive and average the estimated resistive portion R(t) over a determined time period. Since estimated resistive portion R(t) is indicative of changes in voice coil temperature, deriving a moving averaging of the estimated resistive portion R(t) with the moving average module 1002 may be used to monitor long term heating of the voice coil of the loudspeaker 106.

The moving averaging of the estimated resistive portion R(t) may be compared against one or more boundary values indicative of a desired resistive portion R(t) of the loudspeaker 106 by the load power comparator 150 to determine if a threshold has been eclipsed. When the moving averaging of the estimated resistive portion R(t) exceeds one of the boundaries indicating that the threshold has been crossed, a limiting signal may be generated by the load power comparator 150 and provided to the limiter 116 that is indicative of the threshold being exceeded. Upon receipt of the limiting signal, the limiter 116 may take action to minimize undesirably high temperatures and/or undesirable low temperatures of the voice coil. The boundary value for comparison to the estimated resistive portion R(t) may be a stored predetermined value. Alternatively, the boundary value may be dynamically updated in real-time based on estimated operational characteristics provided to the load power comparator 150 from the parameter computer 112 on the estimated operational characteristics line 144. For example, the real-time loudspeaker parameters of the loudspeaker 106 may be used by the load power comparator 150 to derive the boundary as a real-time varying value. Alternatively, the boundaries may be a stored value, or derived in real-time by the parameter computer 112 and provided to the load power computer 150 for use in monitoring the thresholds. In still another alternative, the parameter computer 112 may provide the boundaries on a predetermined time schedule, and/or in response to a predetermined percentage change in the boundary values.

The limiter 116 may apply attenuation to the audio signal to reduce the magnitude of the audio signal and avoid overheating of the voice coil of the loudspeaker 106. Alternatively, or in addition, the limiter 116 may apply gain to the audio signal in order to compensate for compression of the audio content in the audio signal. In another alternative a combination of compensation for compression by selectively applying gain to the audio signal, and selectively applying attenuation may be used. For example, when a first threshold is exceeded based on receipt of a corresponding first limiting signal, the limiter 116 may apply gain to the audio signal to compensate for compression. When a second threshold is exceeded and a corresponding second limiting signal is provided indicating that the voice coil temperature is continuing to increase, the limiter 116 may apply attenuation to the audio signal to avoid undesirable levels of temperature in the voice coil of the loudspeaker 106.

Figure 11:
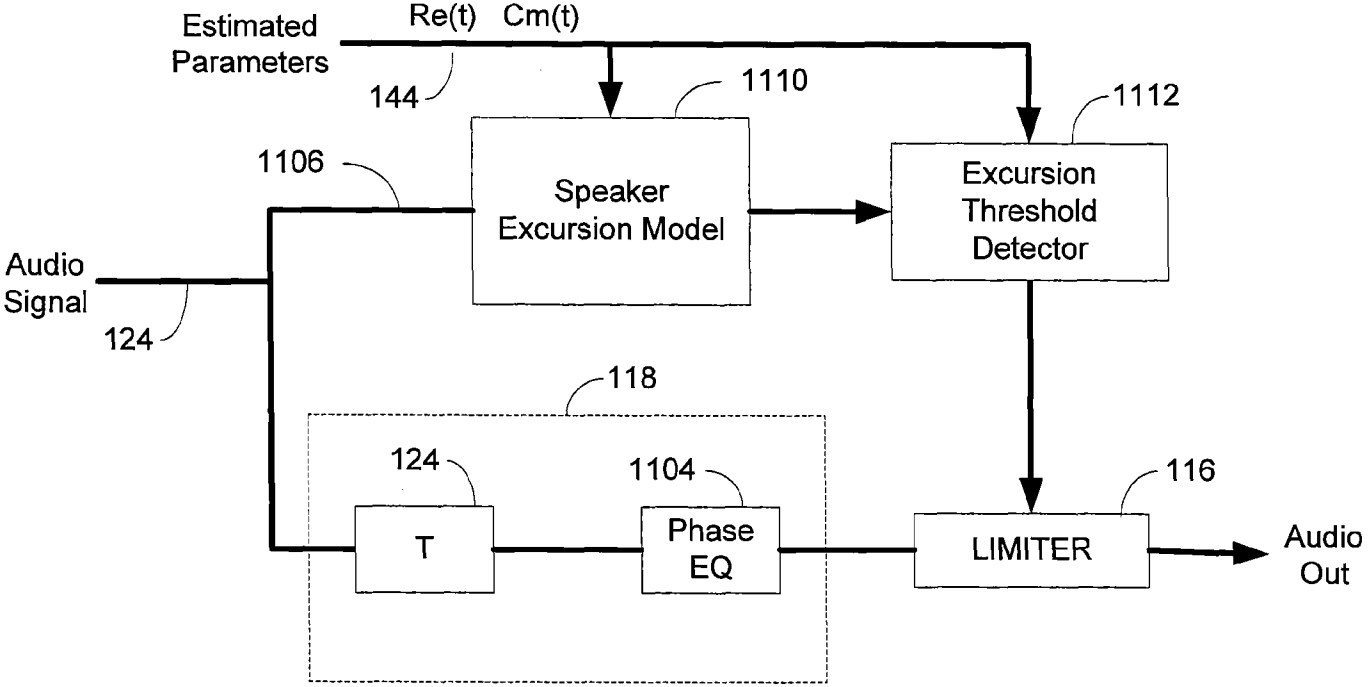
FIG. 11 is an example block diagram of a speaker linear excursion comparator included in the power management system of FIG. 1.

FIG. 11 is an example block diagram of the speaker linear excursion comparator 152 that includes the limiter 116 and the compensation block 118 to develop thresholds used in management of loudspeaker voice coil excursions. The compensation block 118 includes a time delay 1102 and a phase equalizer 1104. The time delay 1102 may provide delay or time shifting of the audio signal to provide additional time for the audio power management system 100 to manage undesirable excursions by the voice coil of the loudspeaker. The phase equalizer 1104 may provide phase compensation as needed to maintain the phase relationship between the audio signal and the real-time actual voltage V(t) within the audio power management system 10. The real-time actual voltage V(t) (conditioned or unconditioned) of the audio signal may be supplied to the speaker linear excursion comparator 152 on a real-time actual voltage line 1106. The speaker linear excursion comparator 152 includes a speaker excursion model 1110 and an excursion threshold detector 1112.

The speaker excursion model 1110 receives the real-time actual voltage V(t) and estimated operational characteristics from the parameter computer 112 on the operational characteristics line 144. In FIG. 11, the operational characteristics received by the speaker excursion model 1110 include an estimated mechanical compliance Cm(t) and an estimated voice coil resistance Re(t). The estimated mechanical compliance Cm(t) and the estimated voice coil resistance Re(t) may be used by the speaker excursion model 1110 to derive a real-time electro-mechanical speaker model representative of the loudspeaker 106. In other examples, additional operational characteristics, such as one or more of the estimated speaker parameters included in FIG. 2 may also be provided by the parameter computer 112 to the speaker excursion model 1110. Based on application of the real-time actual voltage V(t) to the real-time electro-mechanical speaker model, the speaker excursion model 1110 may derive a predicted excursion of the voice coil of the loudspeaker 106 in response to the audio signal.

The excursion of the voice coil may be predicted based on integration over time of the estimated mechanical velocity of the voice coil in response to the real-time actual voltage V(t). In addition, or alternatively, the speaker excursion model 1110 may use a frequency dependent transfer function, such as a filter, to perform real-time computation of predicted voice coil excursion per volt of the real-time actual voltage V(t). Using the estimated mechanical compliance Cm(t) and the estimated voice coil resistance Re(t), the predicted excursion may account for loudspeaker specific operational characteristics due to variations in production, age, temperature, and other parameters affecting voice coil excursion during real-time operation of the loudspeaker 106. The predicted excursion may be provided to the excursion threshold detector 1112.

The excursion threshold detector 1112 may compare the predicted excursion to a boundary representative of the maximum desirable excursion of the voice coil to determine if the developed threshold has been exceeded. The boundary may be a predetermined value stored in the excursion threshold detector 1112. Alternatively, the boundary may be stored in the parameter computer 112 and provided to the excursion threshold detector 1112 on the operational characteristics line 144, or stored anywhere else in the audio system. In addition or alternatively, the boundary may be dynamically updated in real-time by the parameter computer 112 as the estimated and actual operational characteristics of the loudspeaker 106 vary during operation. In still another alternative, the parameter computer 112 may provide the boundary on a predetermined time schedule, and/or in response to a predetermined percentage change in the boundary.

Based on the developed threshold, when the predicted excursion exceeds the boundary, a limiting signal is provided to the limiter 116. The limiter 116 may apply clipping to the audio signal in the time domain in response to receipt of the limiting signal. In addition, or alternatively, the limiter may apply soft clipping to the audio signal in the time domain in response to receipt of the limiting signal. Soft clipping may be used to smooth the sharp corners of a clipped signal, and reduce high order harmonic content in an effort to minimize undesirable auditory effects associated with clipping an audio signal. In addition, or alternatively, the limiter may reduce the gain of the audio signal, such as in the audio amplifier in response to receipt of the limiting signal.

In order for the speaker linear excursion comparator 152 and the limiter 116 to "stay ahead" of undesirable actual excursions of the voice coil in the loudspeaker 106, the latency of modeling of the speaker excursion model may be minimized. In addition, the time delay block 1102 may be used to provide a look ahead capability that may involve predictive interpolation of future real-time actual voltage V(t) of the audio signal.

Figure 12:
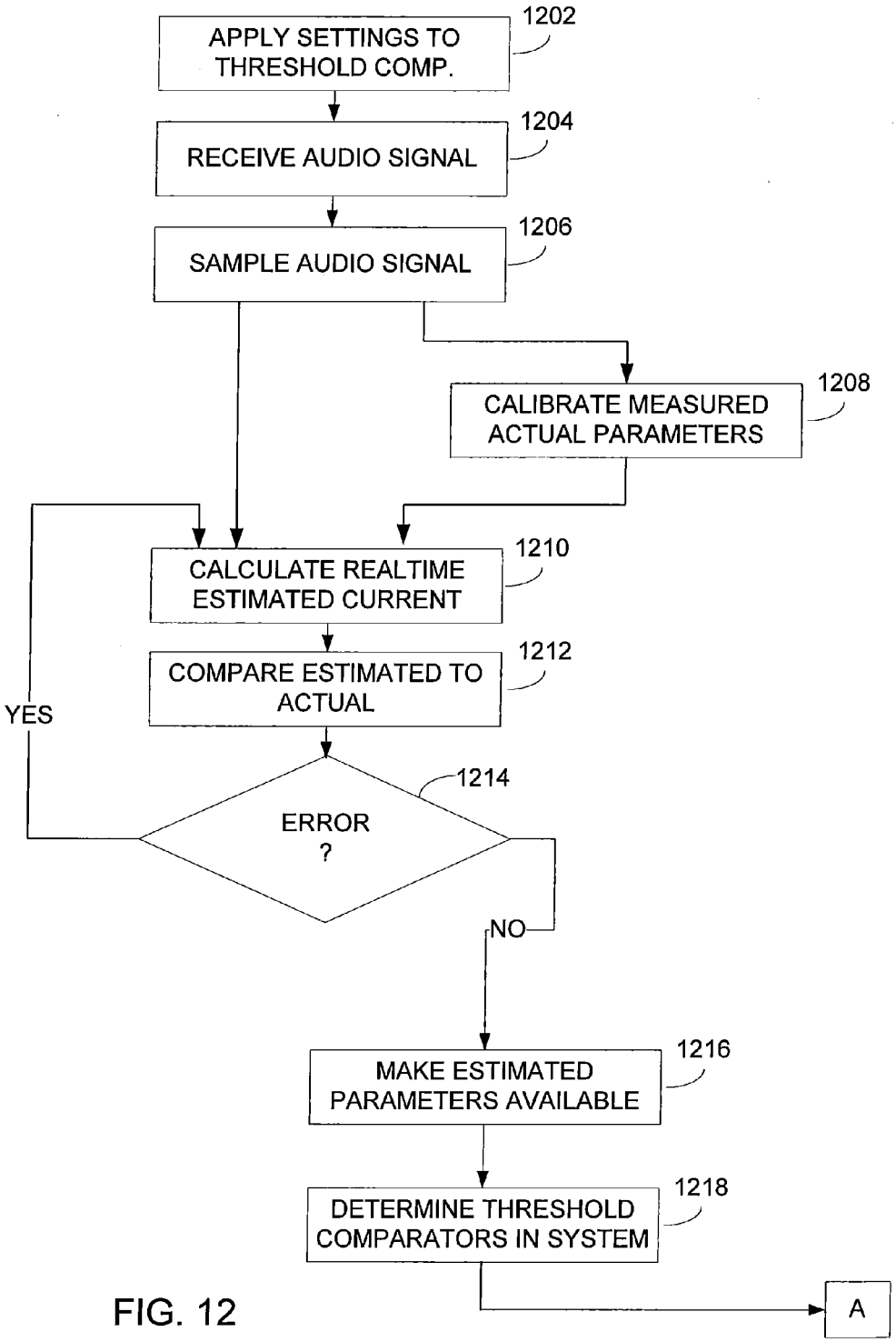
FIG. 12 is an operational flow diagram of the power management system of FIG. 1.

FIG. 12 is an example operational flow diagram for the audio power management system 100 with reference to FIGS. 1-11. At block 1202, the audio power management system 100 is powered up, and the one or more of the threshold comparators 114 are populated with stored settings. The stored settings may be the last known values from previous operation or predetermined stored values. An audio signal is provided to the power management system 100 on the audio signal line 144 at block 1204. At block 1206, the audio signal is sampled to obtain the real-time voltage signal V(t) and the real-time current signal I(t). At block 1208, the real-time voltage signal V(t) and the real-time current signal I(t) may be calibrated with the calibration module 110 and the operation proceeds to block 1210.

Alternatively, the calibration of the real-time voltage signal V(t) and the real-time current signal I(t) may be omitted and the operation proceeds directly to block 1210. At block 1210 the parameter computer 112 receives and uses the real-time voltage signal V(t) to derive a real-time estimated current. The real-time estimated current is derived based on estimated operational characteristics, such as the estimated operational characteristics of the loudspeaker 106. The real-time estimated current is compared to the real-time current signal I(t) at block 1212. At block 1214, it is determined if greater than a pre-determined difference (error) exists between the estimated real-time current and the real-time actual current I(t). If yes, the operation adjusts the estimated operational characteristics and returns to block 1210 to recalculate the estimated real-time current based on the adjusted operational characteristics.

Figure 13:
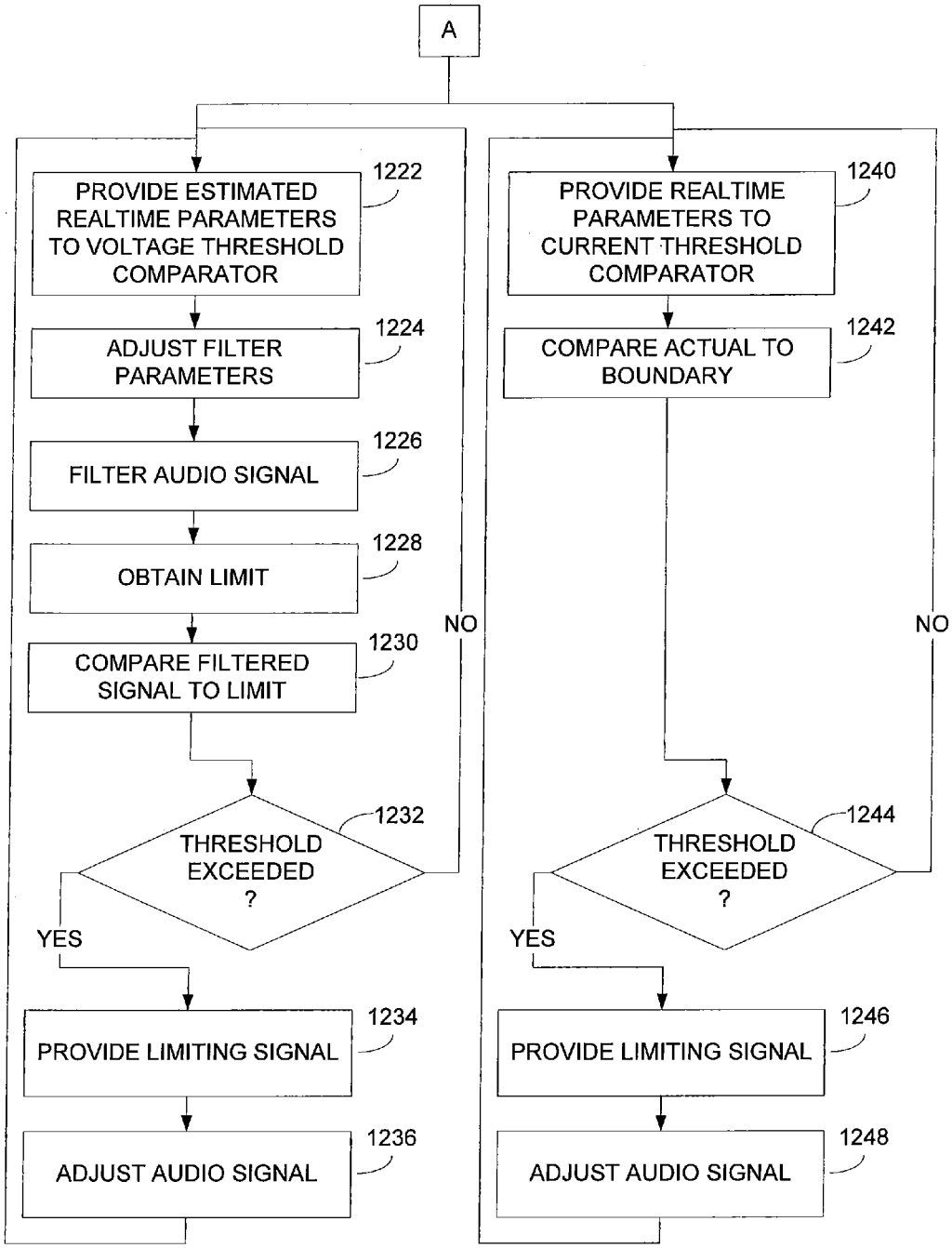
FIG. 13 is a second part of the operational flow diagram of FIG. 12.
Figure 14:
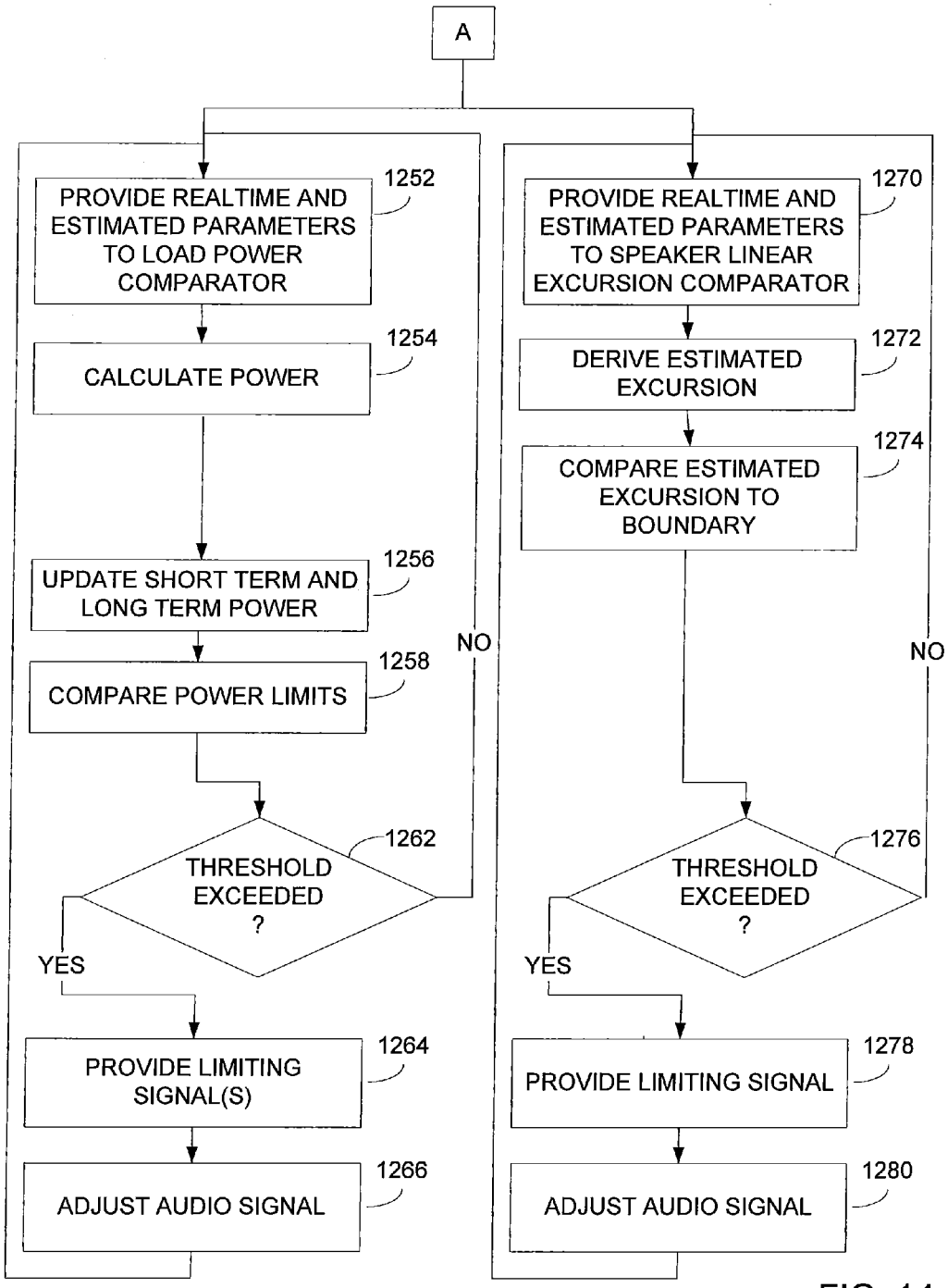
FIG. 14 is a third part of the operational flow diagram of FIG. 12.

Referring to FIG. 13, if at block 1214, the difference in real-time estimated current and the real-time actual current I(t) are within an acceptable predetermined range (converge), at block 1216 the estimated operational characteristics, such as the estimate speaker parameters are made available for use as estimated real-time parameters by the threshold comparators 114 in performing threshold development and monitoring. In other examples, such as when a current amplifier is used, the real-time actual current I(t) may be used to derive a real-time estimated voltage, which is compared to the real-time actual voltage V(t).

At block 1218 it is determined which of the threshold comparators 114 are operable in the audio power management system 100. If the voltage threshold comparator 146 is operable in the audio power management system 100, at block 1222, the estimated real-time parameters are selectively provided to the voltage threshold comparator 146. The filter parameters of the voltage threshold comparator 146 are adjusted based on the estimated real-time parameters at block 1224. At block 1226 the real-time actual voltage V(t) is filtered by the voltage threshold comparator to align the real-time actual voltage V(t) over the range of frequency with the estimated resonance frequency of the loudspeaker 106. Accordingly, the filtered real-time actual voltage V(t) may be adjusted according to the estimated real-time resonant frequency of the loudspeaker in order to represent the available operational capability of the loudspeaker based on the estimated resonance frequency.

At block 1228, a changeable or static limit value representative of a frequency dependent desired voltage level may be received from the parameter computer 112, derived by the voltage threshold comparator 146, and/or retrieved from some other location. The filtered real-time actual voltage V(t) may be compared to the limit value, such as by curve fitting, at block 1230. It is determined if the filtered real-time actual voltage V(t) exceeds the threshold at block 1232. If no, the operation returns to block 1222. If at block 1232 the filtered real-time actual voltage V(t) exceeds the threshold, a limiting signal is provided to the limiter 116 at block 1234. At block 1236 the limiter adjusts the audio signal, and the operation returns to block 1222.

Returning to block 1220, if the current threshold comparator 148 is operable in the audio power management system 100, at block 1240, the current threshold comparator 148 receives the real-time actual current I(t). In addition, the current threshold comparator 148 may selectively receive the changeable or static boundary value representative of a maximum desired current at a predetermined interval from the parameter computer 112, selectively derive the maximum desired current, and/or retrieve the maximum desired current from some other storage location. At block 1242, the current threshold comparator 148 may compare the real-time actual current I(t) to the boundary value. It is determined at block 1244 if the real-time actual current I(t) exceeds the boundary value at block 1244. If not, the operation returns to block 1240. If at block 1244, the real-time actual current I(t) exceeds the threshold, a limiting signal is generated and provided to the limiter 116 at block 1246. At block 1248 the limiter adjusts the audio signal, and the operation returns to block 1240.

Returning again block 1220, if the load power comparator 150 is operable in the audio power management system 100, at block 1252, the load power comparator 150 receives at least one of the real-time actual current I(t) and real-time actual voltage V(t) (conditioned or unconditioned). In addition or alternatively, the load power comparator 150 may selectively receive estimated real-time parameters such as estimated real-time speaker parameters from the parameter computer 112. Further, the load power comparator 150 may receive the changeable or static limits representative of desired levels of power at a predetermined interval from the parameter computer 112 or some other storage location or derive the changeable or static limits. At block 1254, the load power comparator 150 may calculate instantaneous power based on the real-time estimated and/or actual current or voltage.

The calculated instantaneous power may be used to update short average power and the long average power values at block 1256. At block 1258, the instantaneous, short term and long term calculated power may be compared to respective limits. It is determined if the instantaneous power, the short term power, or the long term power exceeds the respective thresholds at block 1262. If not, the operation returns to block 1252. If at block 1262 any or all of the instantaneous power, the short term power, or the long term power exceeds the respective thresholds, the load power comparator 150 generates corresponding limiting signal(s) and provides the corresponding limiting signal(s) to the limiter 116 at block 1264. At block 1266, the limiter 116 adjusts the audio signal accordingly based on the received limiting signal(s).

Returning again block 1220, if the speaker linear excursion comparator 152 is operable in the audio power management system 100, at block 1270, the speaker linear excursion comparator 152 receives the real-time actual voltage V(t) (conditioned or unconditioned) and estimated real-time parameters such as estimated real-time speaker parameters from the parameter computer 112. Further, the load power comparator 150 may receive one or more of the changeable or static boundaries representative of desired excursion levels of the voice coil of the loudspeaker 106 from the parameter computer 112 or some other storage location, or derive the changeable or static boundaries. At block 1272, the estimated excursion is derived by application of the real-time actual voltage V(t) and estimated real-time parameters to the real-time electro-mechanical speaker model. The estimated excursion is compared to the boundaries at block 1274. At block 1276 it is determined if any of the thresholds have been exceeded. If not, the operation returns to block 1270. If any of the thresholds have been exceeded at block 1276, then at block 1278 corresponding limiting signals are generated and provided to the limiter 116. At block 1280, the limiter 116 adjusts the audio signal according to the respective limiting signals received.

As previously described, the audio power management system 100 provides management of loudspeakers, amplifiers, audio sources and any other components in an audio system. By using real-time measured actual parameters, the audio power management system 100 may customize management of the various components in the audio system. In the case of protective management, the audio power management system 100 may develop and adjust various protective thresholds for individual devices in real-time to allow maximum operational capability of the respective devices while still maintaining operational parameters, such as the audio signal within limits that would otherwise have undesirable detrimental effects on the hardware of the audio system. In the case of operational management, the audio power management system may optimize power consumption, performance, and functionality by adjusting operational thresholds for individual devices in real-time to minimize distortion, clipping and other undesirable anomalies that may otherwise occur.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A power management system for an audio system comprising:

a processor;

a threshold comparator executable with the processor to develop and monitor a threshold in real-time based on a measured actual parameter of an audio signal driving a loudspeaker and an estimated operational characteristic of the loudspeaker; and a limiter in communication with threshold comparator, the limiter positioned between an audio source supplying the audio signal and the loudspeaker in receipt of the audio signal, the limiter executable with the processor to selectively adjust the audio signal in real-time based on the threshold.

2. The power management system of claim 1, where the threshold comparator comprises a current threshold comparator, the current threshold comparator executable with the processor to develop a high electrical current threshold in real-time based on the measured actual parameter and the estimated operational characteristic of the loudspeaker.

3. The power management system of claim 2, where the estimated operational characteristic of the loudspeaker comprises an electrical current boundary parameter determined based on a speaker model, and the measured actual parameter is an audio signal electrical current, and the limiter is a voltage limiter executable with the processor to maintain electrical current in the audio signal below the threshold.

4. The power management system of claim 1, where the threshold comparator comprises a voltage threshold detector, the voltage threshold detector executable with the processor to generate a frequency based high voltage threshold in real-time based on the measured actual parameter and the estimated operational characteristic.

5. The power management system of claim 4, where the frequency based high voltage threshold is determined based on a real-time estimated resonance frequency of the loudspeaker determined by the threshold comparator based on the estimated operational characteristic of the loudspeaker, and the measured actual parameter of the audio signal driving the loudspeaker.

6. The power management system of claim 1, where the measured actual parameter of the audio signal comprises a real-time actual voltage and a real-time actual current.

7. The power management system of claim 1, where the estimated operational characteristic of the loudspeaker comprises an estimated mechanical compliance and an estimated voice coil resistance of the loudspeaker, the threshold comparator executable with the processor to derive a real-time electro-mechanical speaker model representative of the loudspeaker and use the real-time electro-mechanical speaker model to determine a predicted excursion of a voice coil of the loudspeaker as the threshold.

8. The power management system of claim 1, further comprising a calibration module executable with the processor to receive, condition the measured actual parameter, and provide the conditioned measured actual parameter to the threshold comparator.

9. A method of power management for an audio system comprising:

receiving a measured actual parameter of an audio signal driving a loudspeaker with a processor;

retrieving, with the processor, an estimated speaker parameter representative of operational characteristics of the loudspeaker based on the measured actual parameter of the audio signal driving the loudspeaker;

generating a threshold with the processor in real-time based on the estimated speaker parameter and the measured actual parameter; and selectively adjusting the audio signal driving the loudspeaker in real-time with the processor based on the generated threshold.

10. The method of claim 9, where the measured actual parameter comprises a real-time actual voltage and a real-time actual current and the estimated real-time parameter comprises an estimate voltage, the real-time actual current used in conjunction with an estimated speaker model to generate the estimated voltage.

11. The method of claim 10, where generating the threshold comprises generating a frequency based high voltage threshold.

12. The method of claim 9, where the threshold is representative of a maximum voice coil excursion.

13. The method of claim 9, where the threshold is a speaker protection parameter.

14. A power management system for an audio system comprising:

a processor; a first threshold comparator executable with the processor to monitor a measured actual parameter of an audio signal in accordance with a first threshold;

a second threshold comparator executable with the processor to monitor the measured actual parameter in accordance with a second threshold;

the first threshold comparator further executable with the processor to establish exceedance of the first threshold based on at least one of estimated operational characteristics of a loudspeaker or the measured actual parameter; and the second threshold comparator further executable with the processor to establish exceedance of the second threshold based on at least one of the estimated operational characteristics of the loudspeaker or the measured actual parameter.

15. The power management system of claim 14, further comprising a limiter in communication with first threshold comparator and the second threshold comparator, the limiter executable with the processor to independently adjust the audio signal driving the loudspeaker in response to a first limiting signal from the first threshold comparator and a second limiting signal from the second threshold comparator.

16. The power management system of claim 14, further comprising a first limiter in communication with first threshold comparator and a second limiter in communication with the second threshold comparator, the first limiter and the second limiter executable with the processor to independently adjust the audio signal driving the loudspeaker in response to a respective first limiting signal from the first threshold comparator and a respective second limiting signal from the second threshold comparator.

17. The power management system of claim 14, where the first threshold comparator is a voltage threshold comparator and the estimated operational characteristics comprise an estimated resonance frequency of the loudspeaker, the voltage threshold comparator executable with the processor to vary the operational characteristics in response to changes in the voltage of the audio signal as a function of the estimated resonance frequency of the loudspeaker.

18. The power management system of claim 17, where the second threshold comparator is a current threshold comparator and the estimated operational characteristics comprise an estimated resistance of the loudspeaker, the current threshold comparator executable with the processor to vary the second threshold in response to changes in a real-time actual voltage of the audio signal, and the estimated resistance of the loudspeaker.

19. The power management system of claim 14, where the first threshold comparator is a speaker linear excursion comparator and the estimated operational characteristics comprise an estimated voice coil resistance of the loudspeaker, and an estimated mechanical compliance of the loudspeaker, the speaker linear excursion comparator executable with the processor to derive a real-time electro-mechanical speaker model representative of the loudspeaker based on at least the estimated voice coil resistance of the loudspeaker and the estimated mechanical compliance.

20. The power management system of claim 19, where the second threshold comparator is a load power comparator, the estimated operational characteristics comprise an estimated resistance of the loudspeaker, and the measured parameter comprises a real-time actual current of the audio signal, the load power comparator executable with the processor to calculate an estimated magnitude of power at the loudspeaker in real-time based on the estimated resistance of the loudspeaker and the real-time actual current.

* * * * *